US010166696B2

(12) United States Patent
Casper et al.

(10) Patent No.: US 10,166,696 B2
(45) Date of Patent: Jan. 1, 2019

(54) SAFETY DEVICE, BACKFLOW REDUCTION DEVICE, CONFORMABLE WOOD PROCESSING DEVICE, AND METHODS THEREOF FOR A WASTE PROCESSING SYSTEM

(75) Inventors: Thomas E. Casper, Shepherd, MI (US); Michael B. Morey, Shepherd, MI (US)

(73) Assignee: BANDIT INDUSTRIES, INC., Remus, MI (US)

( * ) Notice: Subject to any disclaimer, the term of this patent is extended or adjusted under 35 U.S.C. 154(b) by 1322 days.

(21) Appl. No.: 14/233,869

(22) PCT Filed: Jul. 21, 2012

(86) PCT No.: PCT/US2012/047773
§ 371 (c)(1),
(2), (4) Date: Jan. 20, 2014

(87) PCT Pub. No.: WO2013/013233
PCT Pub. Date: Jan. 24, 2013

(65) Prior Publication Data

US 2014/0138464 A1 May 22, 2014

Related U.S. Application Data

(60) Provisional application No. 61/510,142, filed on Jul. 21, 2011.

(51) Int. Cl.
*B02C 18/16* (2006.01)
*B02C 23/04* (2006.01)
(Continued)

(52) U.S. Cl.
CPC ..... *B27L 11/02* (2013.01); *B02C 18/145* (2013.01); *B02C 18/16* (2013.01);
(Continued)

(58) Field of Classification Search
CPC ..... B27L 11/02; B27L 11/08; B02C 18/16; B02C 23/04; B02C 18/2283;
(Continued)

(56) References Cited

U.S. PATENT DOCUMENTS 190,675 A 5/1877 Gaines
589,236 A 8/1897 Williams
(Continued)

FOREIGN PATENT DOCUMENTS

CA 2103633 3/1994
CA 2133119 4/1995
(Continued)

OTHER PUBLICATIONS

International Search Report for PCT/US2012/047773 dated Jul. 21, 2012, 2 pages.
(Continued)

*Primary Examiner* — Anthony Stashick
*Assistant Examiner* — Onekki Jolly
(74) *Attorney, Agent, or Firm* — Howard & Howard Attorneys PLLC

(57) ABSTRACT

A safety device for a waste processing system having a powered cutting system including a rotor rotatably mounted within a housing is disclosed wherein the improvement relates to a safety device which includes a first safety device disposed within the housing, spaced from the rotor and thereby defining a first gap therebetween through which a cable that has been captured by the rotor assembly is automatically cleaved when disposed between the first safety device and rotor assembly.

35 Claims, 26 Drawing Sheets

(51) Int. Cl.

| | |
|---|---|
| ***B27L 11/02*** | (2006.01) |
| ***B02C 18/14*** | (2006.01) |
| ***B02C 18/22*** | (2006.01) |
| ***B27L 11/08*** | (2006.01) |
| *B02C 18/18* | (2006.01) |

(52) U.S. Cl.
CPC ..... *B02C 18/2283* (2013.01); *B02C 23/04* (2013.01); *B27L 11/08* (2013.01); *B02C 2018/164* (2013.01); *B02C 2018/168* (2013.01); *B02C 2018/188* (2013.01)

(58) Field of Classification Search
CPC ..... B02C 18/145; B02C 2018/168; B02C 2018/164; B02C 2018/188
USPC ..... 241/88.4, 101.2, 189.1, 222, 225, 240, 241/242, 280
See application file for complete search history.

(56) References Cited

U.S. PATENT DOCUMENTS 604,283 A 5/1898 Albrecht
1,266,894 A 5/1918 Williams
1,713,507 A 5/1929 Ammon
1,752,290 A 4/1930 Ammon
1,889,129 A 11/1932 Nielsen
2,026,790 A 1/1936 Mankofl
2,128,194 A 8/1938 Sheldon
2,216,612 A * 10/1940 Dimm ..... B02C 18/186 241/101.3
2,244,577 A 6/1941 Schreiber
2,318,219 A 5/1943 Harris
2,392,958 A 1/1946 Tice
2,663,505 A 12/1953 Sennholtz
2,710,635 A 6/1955 Alexander
2,863,476 A 12/1958 Clark
2,864,420 A 12/1958 Schmidt
3,254,687 A 6/1966 Tertyshnikov
3,367,585 A 2/1968 Ratkowski
3,430,873 A 3/1969 Wahl et al.
3,436,028 A 4/1969 Koehnen et al.
3,509,924 A 5/1970 Newhouse, Jr.
3,642,214 A 2/1972 Blackwell, Jr.
3,659,794 A * 5/1972 Hemesath ..... B02C 13/095 241/189.1
3,844,494 A 10/1974 Hightower
3,907,016 A 9/1975 Nicholson et al.
4,049,206 A * 9/1977 Konig ..... B02C 13/095 241/189.2
4,074,594 A 2/1978 Dall et al.
4,077,450 A 3/1978 Ackerman
4,117,985 A 10/1978 Lazareck
4,129,260 A 12/1978 Baker
4,146,184 A 3/1979 Whitney
4,162,769 A 7/1979 Lapointe
4,168,035 A 9/1979 Palm et al.
4,504,019 A 3/1985 Newell et al.
4,702,424 A 10/1987 Widlak
4,717,083 A 1/1988 Quast et al.
4,850,406 A 7/1989 Krautzberger
4,872,500 A 10/1989 Duffey et al.
4,915,310 A 4/1990 Stelk
4,917,314 A 4/1990 Manschwetus
4,922,977 A 5/1990 Colton et al.
4,967,969 A 11/1990 Griffith, III
4,982,904 A 1/1991 Greiner
5,004,028 A 4/1991 Adams et al.
5,005,620 A 4/1991 Morey
5,042,727 A 8/1991 Plante
5,044,567 A 9/1991 Hte et al.
5,078,328 A 1/1992 Willingham
5,114,085 A 5/1992 Inui
5,205,496 A 4/1993 O'Donnell et al.
5,209,278 A 5/1993 Carpenter et al.
5,285,974 A 2/1994 Cesarini et al.
5,362,004 A 11/1994 Bateman
5,372,316 A 12/1994 Bateman
5,377,919 A 1/1995 Rogers et al.
5,413,286 A 5/1995 Bateman
5,472,146 A * 12/1995 Doppstadt ..... B02C 13/04 241/101.76
5,474,239 A 12/1995 Williams, Jr. et al.
5,509,453 A 4/1996 Crockett
5,526,988 A 6/1996 Rine
5,547,136 A 8/1996 Steffens et al.
5,683,042 A 11/1997 Giovanardi
5,692,548 A 12/1997 Bouwers et al.
5,947,395 A * 9/1999 Peterson ..... B02C 18/225 241/223
5,988,539 A * 11/1999 Morey ..... B02C 18/14 241/34
6,032,707 A 3/2000 Morey et al.
6,138,932 A 10/2000 Moore
7,083,129 B2 * 8/2006 Beam ..... A01G 3/002 241/37.5
7,513,449 B2 4/2009 Gross et al.
7,971,818 B2 * 7/2011 Smidt ..... B02C 18/145 241/186.35
2003/0141394 A1 * 7/2003 Ueda ..... B02C 18/18 241/73
2008/0296420 A1 12/2008 Brand et al.
2010/0294868 A1 11/2010 Galloway et al.
2011/0111456 A1 5/2011 Medoff
2012/0043404 A1 * 2/2012 Morey ..... B02C 25/00 241/25

FOREIGN PATENT DOCUMENTS

| | | |
|---|---|---|
| CA | 2133120 | 4/1995 |
| CA | 2132942 | 3/1996 |
| DE | 3631337 A1 | 3/1988 |
| EP | 2338601 | 6/2011 |
| WO | 2013013233 A1 | 1/2013 |

OTHER PUBLICATIONS

Australian Patent Examination Report for AU2012285828 dated Jul. 20, 2016, 5 pages.
English language abstract, and machine-assisted English language translation of German Patent Publication No. DE 36 31 337 A1 extracted from www.espacenet.com on May 1, 2018; 5 pages.

* cited by examiner

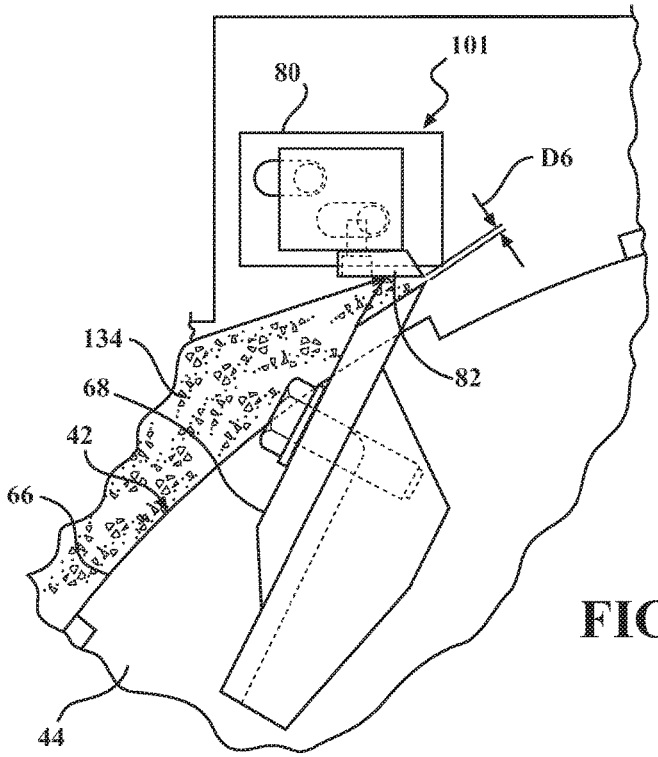
FIG. 20A
FIG. 20B
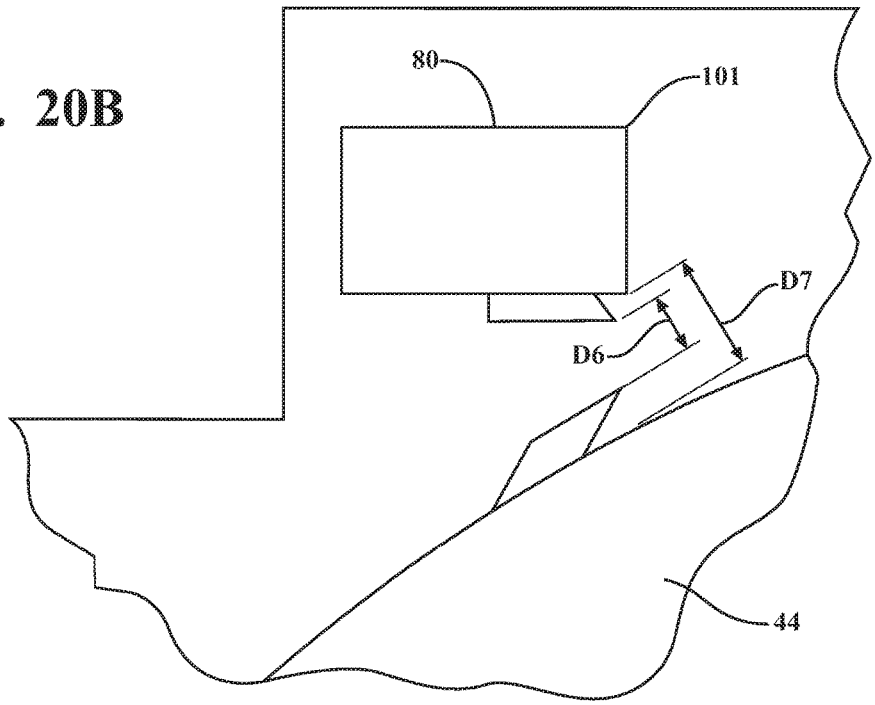

SAFETY DEVICE, BACKFLOW REDUCTION DEVICE, CONFORMABLE WOOD PROCESSING DEVICE, AND METHODS THEREOF FOR A WASTE PROCESSING SYSTEM

CROSS REFERENCE TO RELATED APPLICATIONS

This application claims the benefit of the filing date of U.S. provisional application Ser. No. 61/510,142 entitled "SAFETY DEVICE, BACKFLOW REDUCTION DEVICE, CONFORMABLE WOOD PROCESSING DEVICE, AND METHODS THEREOF FOR A WASTE PROCESSING SYSTEM" which was filed on Jul. 21, 2011 and which is incorporated herein by reference in its entirety.

BACKGROUND OF THE INVENTION

The present invention relates to waste processing systems, and more specifically to safety devices and systems, backflow reduction devices and systems, conformable wood reduction devices and systems, and methods of operation of and for such waste processing systems.

A variety of machines have been developed to recycle, reduce, or otherwise process wood and brush products. Included therein are machines that chip, cut, grind, or otherwise reduce waste (wood) products including, generally, chippers (disk and drum types), hammer mills, hogs, shredders, grinders, and forestry mowers.

These waste processing systems typically include an infeed system and a waste reducing or cutting system, wherein the infeed system is used for directing the waste material to the waste reducing system, the waste reducing system being used for reducing the waste material. These waste processing systems also include a discharge system for removing and directing the reduced material.

These waste processing systems include large, industrial conveyer fed waste processing machines which are capable of quickly reducing bulky (e.g., large size) wood products, as well as doing so in high volume applications. For example, conveyor-fed systems may be used to reduce large tree stumps and trunks, as well as branches, brush, and other bulk wood products. These known systems generally include: an infeed assembly comprising, for example only, a conveyer infeed system; a feed wheel assembly comprising, for example only, a pair of feed-wheels; a cutting assembly comprising, for example only, a drum assembly further comprising reducing members; and a discharge assembly comprising, for example only, a conveyer discharge system.

Examples of such waste processing machines are disclosed in: U.S. Pat. No. 6,047,912, issued Apr. 11, 2000, entitled "Break-Away Processing Tool For A Waste Processing Machine"; U.S. Pat. Nos. 5,863,003 and 6,299,082; issued Jan. 26, 1999 and Oct. 9, 2001, respectively; all to Smith; and entitled "Waste Processing Machine"; U.S. Pat. No. 6,059,210 issued May 9, 2000 to Smith, entitled "Rotor Assembly For A Waste Processing Machine"; U.S. Pat. No. 6,517,020, issued Feb. 11, 2003 to Smith, entitled "Replaceable Raker Assembly For Processing Tool Of Waste Processing Machine"; U.S. Pat. No. 6,299,082, issued Oct. 9, 2001 to Smith, entitled "Waste Processing Machine"; U.S. Pat. Nos. 6,845,931, 7,121,485, 7,384,011, and 7,726,594; issued Jan. 25, 2005, Oct. 17, 2006, Jun. 10, 2008, and Jun. 1, 2010, respectively; all to Smith; and entitled "Multi-Functional Tool Assembly For Processing Tool of Waste Processing Machine"; and U.S. Pat. No. 7,163,166, issued Jan. 16, 2007 to Smith, entitled "Rotatable Assembly For Machines", all of which are incorporated herein by reference in their entirety.

These waste processing systems also include wood chippers. For example, hand-fed wood chippers are used to reduce trees, branches, brush, and other bulk wood products into smaller wood chips. A typical wood chipper includes an infeed chute; a feed system which may be adapted for controlling the feed rate of wood products; a wood chipping mechanism (disc or drum); a drive system for the feed system and chipping mechanism; and a discharge chute. More particularly, the infeed chute is typically a funnel-type conduit provided with a wide opening which tapers toward the feed system to converge the bulk wood/waste products toward the chipping mechanism and, through the action of the feed system, the bulk wood products are brought into contact with the chipping mechanism which grinds, flails, cuts, or otherwise reduces the wood and waste products into smaller pieces. The smaller pieces are then propelled out of the discharge chute. An example of such a wood chipper is disclosed in U.S. Pat. No. 5,988,539, issued Nov. 23, 1999 to Morey, and entitled "Wood Chipper With Infeed Chute Safety Device" which is incorporated herein by reference in its entirety. In these known systems, the wood chipper generally includes an infeed assembly, feed wheel assembly, and a cutting assembly having a rotatable disc or drum with at least one knife or blade for chipping the wood entering the wood chipper and reducing it to wood chips. The chipper also includes a discharge chute for allowing the wood chips to exit the wood chipper, as well as for generally directing them during discharge.

Other examples of such wood chippers are disclosed in U.S. Pat. No. 6,032,707, issued Mar. 7, 2000 to Morey et al., entitled "Drum Assembly For A Wood Chipper"; U.S. Pat. No. 6,036,125, issued Mar. 14, 2000 to Morey et al., entitled "Wood Chipper"; U.S. Pat. No. 5,988,539, issued Nov. 23, 1999 to Morey, entitled "Wood Chipper With Infeed Chute Safety Device"; U.S. Pat. No. 6,000,642, issued Dec. 14, 1999 to Morey, entitled "Wood Chipper With Infeed Chute Safety Device"; U.S. Pat. No. 6,722,596, issued Apr. 20, 2004 to Morey, entitled "Multiple Wheel Feed Wheel Assembly For A Wood Chipper"; U.S. Pat. No. 6,357,684, issued Mar. 19, 2002 to Morey, entitled "Adjustable Tension Feed Wheel Assembly For A Wood Chipper"; U.S. Pat. No. 6,830,204, issued Dec. 14, 2004 to Morey, entitled "Reversing Automatic Feed Wheel Assembly For A Wood Chipper"; U.S. Pat. No. 6,814,320, issued Nov. 9, 2004 to Morey et al., entitled "Reversing Automatic Feed Wheel Assembly For Wood Chipper", all of which are incorporated herein by reference in their entirety.

Further, and by way of exemplary embodiments only, the feed wheel assemblies of these waste processing systems, including wood chippers may comprise: a stationary lower feed wheel, connected to a lower housing; and a movable upper feed wheel, connected to an upper housing and movable relative to the lower housing for allowing wood to enter the cutting assembly. Further, one or both of the feed wheels may be rotatably powered or driven. These waste processing and chipper systems are also typically powered via an internal combustion, and again by way of example only: may include one or more hydraulic pumps which supply one or more hydraulic drives or motors for rotating the one or more feed wheels; and may also include one or more drive belts and pulley systems which drive the rotatable disc or drum of the cutting assembly.

Additionally, it is known to utilize cords, ropes, or other lines to gather and feed the bulk wood products in order to make them ready to be reduced by the waste processing system. Typically these cables are used to gather, secure, drag, lift, etc., the bulk wood products onto and into the infeed system for capture by the feed system. This gathering and feeding may be done manually or with the assistance of a winch and winch line.

However, although these existing types of systems have worked well, if proper procedures are not followed, they suffer from the disadvantage that, inter alia, the cable or line may become entangled in the cutting assembly. In turn, this can cause operational downtime and/or damage to one or more systems and components of the waste processing system, or worse, injury. Therefore, there is a need in the art to provide novel devices, systems, and methods for a waste processing system that overcomes the above-identified disadvantages.

Further, devices, systems, and methods for reducing the backflow or blow-back of wood particulate in the reducing chamber are also desired, and yet further devices, systems, and methods for reducing conformable or pliant wood material is further desired.

Accordingly, a need exists for novel devices, systems, and methods which have, among other advantages: the ability to reduce or prevent the risks associated with these prior art waste processing machines; reduce backflow; and process conformable wood products. It is further desirable to provide such devices and systems which are relatively inexpensive to manufacture, assemble, as well as are easily operable. It is also desirable to provide such methods that are effective, cost effective, and are easily maintained and/or followed. Yet further, a need exists for novel devices, systems, and methods which have, among other advantages, the ability to reduce or prevent cables and winch lines from becoming entangled within the reducing systems of these waste processing machines; reducing or preventing these cables and winch lines from becoming entangled in a manner that is automatic and/or does not rely on operator intervention; reducing or preventing backflow within the cutting assemblies; and providing a cutting assembly that reduced conformable wood products more effectively. Therefore, a waste processing system and methods therefor that solve the aforementioned disadvantages and having the aforementioned advantages is desired.

SUMMARY OF THE PRESENT INVENTION

The aforementioned drawbacks and disadvantages of these former waste processing devices, systems, and methods have been identified and solutions are set forth herein by the inventive safety device for a waste processing system. The waste processing system includes a powered cutting system including a rotor rotatably mounted within a housing, wherein the improvement relates to the safety device. The safety devices comprises a first safety device which is disposed within the housing and spaced from the rotor, the spacing thereby defining a first gap therebetween through which a cable that has been captured by the rotor assembly during operation thereof is automatically cleaved when disposed between the first safety device and the rotor assembly.

The inventive safety device may further include a reducing member operatively disposed on the rotor and comprising a first edge, and the first safety device further comprises a second edge, wherein the cable may be cleaved between the first edge of the reducing member and the second edge of the first safety device. Yet further, a second safety device may be disposed within the housing, spaced from the rotor, the space defining a second gap therebetween, wherein the second safety device comprises a third edge and the cable may be cleaved between the first edge of the reducing member and the third edge of the second safety device.

Another aspect of the present invention includes a safety device for a cutting assembly in a waste processing system, the cutting assembly comprising a rotor assembly rotatably mounted to a support member and disposed within a housing, wherein further the rotor assembly comprises a rotor and at least one reducing member including a first cutting edge. The improvement relates to a safety device which includes a first safety device or a first cable cleaving system which is disposed within the housing and includes a second cutting edge which is spaced from the rotor and thereby defines a first gap therebetween (e.g., between the first cutting edge and the second cutting edge) through which a cable which is captured by the rotor assembly is automatically cleaved between the first cutting edge of the reducing member and the second cutting edge of safety device (e.g., between the first gap) when the cable is disposed between the first gap, upon rotation of the rotor and as the cable is wrapped around the rotor. The safety device may also include a second safety device or a second cable cleaving system which is disposed within the housing radially aft of the first safety device and which includes a third cutting edge spaced from the rotor which thereby defines a second gap therebetween (e.g., between the first cutting edge and the third cutting edge) through which a cable captured by the rotor assembly and not separated by the first safety device is automatically cleaved between the first cutting edge of the reducing member and the third cutting edge of safety device (e.g., between the second gap) when the cable is disposed between the second gap, upon rotation of the rotor and as the cable is wrapped further around the rotor.

In another aspect of the present invention, a waste processing system or machine comprises a cutting assembly which is spaced from an infeed assembly, wherein the cutting assembly is operatively disposed within a housing, the housing defining a cutting chamber. The cutting assembly comprises a rotor assembly which is rotatably mounted to a support member and the support member is operatively connected to the housing, wherein the rotor assembly comprises a rotor and at least one reducing member which is mounted to the rotor. The waste processing system also includes a first safety device which is disposed within the cutting chamber and is spaced from the rotor, the space defining a first gap therebetween through which a cable that is captured by the rotor assembly is cleaved between the first safety device and the rotor assembly when the cable is disposed between the first gap.

The inventive waste processing system may further include at least one feed wheel disposed between the infeed assembly and the cutting assembly to feed wood material to the cutting assembly, and may also include a discharge system which is disposed adjacent the cutting assembly, the discharge system being adapted to remove wood waste product particles from the cutting assembly. The system may also include a second safety device which is disposed within the cutting chamber and spaced from the rotor thereby defining a second gap therebetween. Further, the second safety device may be disposed radially 90 degrees from the first safety device. Yet further, the rotor assembly support member may comprise a horizontally disposed axle wherein the rotor assembly is adapted to rotate on the axle. Still further, the housing may comprise a first and a second side wherein the support member is operatively connected to and disposed between the first and second sides of the housing.

Still yet further, the first safety device may be disposed so as to extend between the first and second side of the housing.

The inventive waste processing system may still further include a second safety device which is disposed and extends between the first and the second side of the housing. Further, the cable may be cleaved against the first safety device by the at least one reducing member. Still further, the first safety device may include a second edge which is fixedly disposed a uniform first distance from the rotor and/or the first safety device may comprise a second edge, wherein the cable is cleaved between the second edge and the at least one reducing member and the rotor. Yet further, the reducing member may comprise a first edge and the first safety device may comprise a second edge, wherein the cable is cleaved between the first edge of the reducing member and the second edge of the first safety device. Yet still further, the first safety device may include a cutter, wherein the cutter includes a second edge. Further, the second edge of the cutter may be disposed less than 0.5 inches from a first edge of the reducing member. Yet further, the cutter may comprise a knife and/or the first gap may be less than 0.5 inches. Still further, a second edge of the first safety device may be spaced from the at least one reducing member, thereby defining the first gap therebetween, wherein the first gap is less than the distance a first edge of the reducing member extends from the rotor. Still further, the waste processing system may comprise a wood chipper wherein the infeed assembly comprises an infeed tray.

The spacing of the first and/or second safety device from the rotor assembly may be varied according to the specific requirements of the end user, for example, the size of the cables being used. One aspect of the invention comprises a first gap that ranges from 0.1% to 0.4% of a diameter of the rotor. Another aspect comprises a first gap comprising a first distance which is less than any other second distance between an outside surface of the rotor assembly and any other surface disposed within the cutting chamber and parallel to the outside surface of the rotor assembly. Yet another aspect includes a first gap which comprises a first distance which is less than any other second distance between an outside surface of the rotor assembly and any other device disposed between the first and second sides of the housing. Still a further aspect comprises a first gap which provides a first clearance which is less than any other second clearance within the housing. Yet a further aspect includes a distance between a first edge of the reducing member and a second edge of the first safety device which defines a cutting zone, wherein any object wrapped about the rotor and passing through the cutting zone is cut off.

And still in another aspect of the present invention, a safety device for a cutting assembly of a waste processing system includes an infeed assembly, a cutting assembly spaced from the infeed assembly wherein the cutting assembly comprises a rotor assembly rotatably mounted to a support member, the cutting assembly being operatively disposed within a housing and the housing defines a reducing chamber comprising a first and a second side. Further, the support member may comprise a horizontally disposed axle which is connected to and disposed between the first and second sides of the housing wherein the rotor assembly is adapted to rotate on the axle. Yet further, the rotor assembly may comprise a rotor including an outside surface and at least one reducing member which is mounted to the rotor and extends from the outside surface. The waste processing system may also include at least one feed wheel which is disposed between the infeed assembly and the cutting assembly and which feeds wood material to the cutting assembly, a discharge system disposed adjacent the cutting assembly, the discharge system adapted to remove the reduce bulk wood products from the cutting assembly, and a first safety device which is disposed and extends between the first and second sides within the cutting chamber and which is uniformly spaced from an outside surface of the rotor, thereby defining a first gap therebetween through which a cable, at least partially wrapped around the rotor assembly, is cleaved between the first safety device and the rotor assembly when the cable is disposed between the first gap.

In yet another embodiment, a wood chipper comprises an infeed assembly and a rotatable cutting assembly which is spaced from the infeed assembly. The cutting assembly comprises a rotor assembly which is rotatably mounted to a support member and is operatively disposed within a housing, the housing defining a cutting chamber comprising a first and a second side. The support member comprises a horizontally disposed axle which is operatively disposed between the first and second sides for rotation wherein the rotor assembly is adapted to rotate on the axle. The rotor assembly comprises a rotor and at least one reducing member which is mounted to the rotor and extends from an outside surface of the rotor, and the reducing member comprises a first edge. Further included is at least one feed wheel disposed between the infeed assembly and the cutting assembly which feeds bulk wood material to the cutting assembly, and a discharge system which is adjacent the cutting assembly and which is adapted to remove reduced bulk wood material from the cutting assembly. The chipper further includes a first safety device which is disposed and extends between the first and second sides within the cutting chamber and is uniformly spaced from the outside surface of the rotor, the space defining a first gap therebetween. The first safety device further comprises a first cutter including a second edge, wherein a cable at least partially captured by the rotor assembly may be cleaved between the first edge of the reducing member and the second edge of the first cutter when the cable is disposed between the first gap. The chipper still further includes a second safety device which is disposed and extends between the first and second sides within the cutting chamber and is uniformly spaced from the outside surface of the rotor, the space defining a second gap therebetween. The second safety device further comprises a second cutter comprising a third edge, wherein a cable at least partially captured by the rotor assembly may be cleaved between at least one of the first edge of the reducing member and the second edge of the first safety device, and the at least one of the first edge of the reducing member and the third edge of the second cutter, when the cable is disposed between at least one of the first or the second gap.

In still another embodiment, a method of cutting a feed cable captured by a rotor assembly of a waste processing machine is disclosed and comprises the steps of: providing a waste processing machine which includes a rotor assembly and a first safety device, the first safety device being operatively disposed with respect to the rotor assembly so as to provide a first gap therebetween, wherein at least one of the rotor assembly and the first safety device is adapted to cleave a cable; and feeding the waste processing machine utilizing the assistance of a cable and/or a winch line; wherein if the cable is captured by the rotor assembly, the cable will be automatically cleaved via at least one of the rotor assembly and the first safety device thereby preventing the cable from being further wound around the rotor assembly.

The inventive method may still further include the steps of providing a second safety device which is operatively disposed with respect to the rotor assembly so as to provide a second gap therebetween; wherein if the cable is captured by the rotor assembly, the cable upon passing through at least one of the first and second gap will be automatically cleaved via at least one of the rotor assembly, the first safety device, and the second safety device thereby preventing the cable from being further wound around the rotor assembly.

In yet another embodiment, a method of cutting a feed cable which has been captured by a rotor assembly of a wood chipper is disclosed and includes the steps of: providing a wood chipper which includes an infeed assembly and a cutting assembly spaced from the infeed assembly. The cutting assembly being operatively disposed within a housing, the housing defining a cutting chamber. The cutting assembly comprises a rotor assembly which is rotatably mounted to a support member, and the support member is operatively connected to the housing. The rotor assembly comprises a rotor and at least one reducing member which is mounted to the rotor and extends from an outside surface thereof. The method further includes providing a first safety device disposed within the cutting chamber and spaced from the rotor so as to define a first gap therebetween, through which a cable which has been captured by the rotor assembly is cleaved between the first safety device and the reducing member when the cable is disposed between the first gap. The method further includes the step of feeding the waste processing machine utilizing the assistance of a cable, wherein if the cable is captured by the rotor, the cable upon passing through the first gap will be cleaved via at least one of the reducing member and the first safety device thereby preventing the cable from being further wound around the rotor.

In still another embodiment, a cutting assembly for a waste processing system which includes a rotor assembly rotatably mounted within a housing, the housing defining a reducing chamber comprising a first and a second side, the rotor assembly comprising a rotor comprising an outside surface, and at least one reducing member mounted to the rotor and extending from the outside surface is disclosed, wherein the improvement relates to a safety device comprising a first safety device disposed and extending between the first and second sides of the reducing chamber and which is spaced from an outside surface of the rotor thereby defining a first gap therebetween through which a cable at least partially wrapped around the rotor assembly is cleaved between the first safety device and the rotor assembly when the cable is disposed between the first gap.

In yet another embodiment, a blowback reduction device for a waste processing system which has a powered cutting system comprising a rotor rotatably mounted within a housing is disclosed, wherein the improvement relates to a blowback reduction device which comprises an elongated support which is disposed within the housing, adjacent the rotor, and spaced from the rotor thereby defining a first restriction therebetween through which wood particles are restricted from travelling further along the rotor via the first restriction, thereby preventing or reducing blowback.

The inventive device may further include still a knife affixed to the elongated support and disposed between the support and the rotor and further, the elongated support may be uniformly disposed adjacent the housing.

In still another embodiment, a method of reducing wood particulate backflow in a waste processing machine cutting assembly comprises: providing a cutting assembly for a waste processing machine including a rotor assembly and a blowback reduction device operatively disposed with respect to the rotor assembly so as to provide a first and a second restriction therebetween; feeding the waste processing machine bulk wood product; and intermittently restricting the flow of wood particles within the cutting assembly between the first and second restrictions.

Other objects, advantages, and features of the invention will become apparent upon consideration of the following detailed description and drawings. As such, the above brief descriptions set forth, rather broadly, the more important features of the present novel invention so that the detailed descriptions that follow may be better understood and so that the contributions to the art may be better appreciated. There are of course additional features that will be described hereinafter which will form the subject matter of the claims.

In this respect, before explaining the preferred embodiment of the disclosure in detail, it is to be understood that the disclosure is not limited in its application to the details of the construction and the arrangement set forth in the following description or illustrated in the drawings. To wit, the waste processing systems, devices, and methods of the present disclosure are capable of other embodiments and of being practiced and carried out in various ways. Also, it is to be understood that the phraseology and terminology employed herein are for description and not limitation. Where specific dimensional and material specifications have been included or omitted from the specification, or the claims, or both, it is to be understood that the same are not to be incorporated into the claims, unless so claimed.

As such, those skilled in the art will appreciate that the conception upon which this disclosure is based may readily be used as a basis for designing other structures, methods, and systems for carrying out the several purposes of the present invention. It is important therefore that the claims be regarded as including such equivalent constructions, as far as they do not depart from the spirit and scope of the present invention.

Further, the purpose of the Abstract is to enable the United States Patent and Trademark Office, the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any way.

These and other objects, along with the various features and structures that characterize the invention, are pointed out with particularity in the claims annexed to and forming a part of this disclosure. For a better understanding of the waste processing system of the present disclosure, its advantages, and the specific traits attained by its use, reference should be made to the accompanying drawings and other descriptive matter in which there are illustrated and described the preferred embodiments of the invention.

As such, while embodiments of the waste processing system are herein illustrated and described, it is to be appreciated that various changes, rearrangements, and modifications may be made therein without departing from the scope of the invention as defined by the claims.

BRIEF DESCRIPTION OF THE DRAWINGS

As a compliment to the description and for better understanding of the specification presented herein, 25 pages of drawings are disclosed with an informative, but not limiting, intention.

FIG. 20A is an enlarged partial sectional side view of the blowback reduction device of FIG. 19, and illustrating material flow;

FIG. 20B is an enlarged partial sectional side view of the blowback reduction device of FIG. 20A;

DETAILED DESCRIPTION OF THE PREFERRED EMBODIMENT

The best mode for carrying out the invention is presented in terms of the preferred embodiment, wherein similar referenced characters designate corresponding features throughout the several figures of the drawings.

Figure 4:
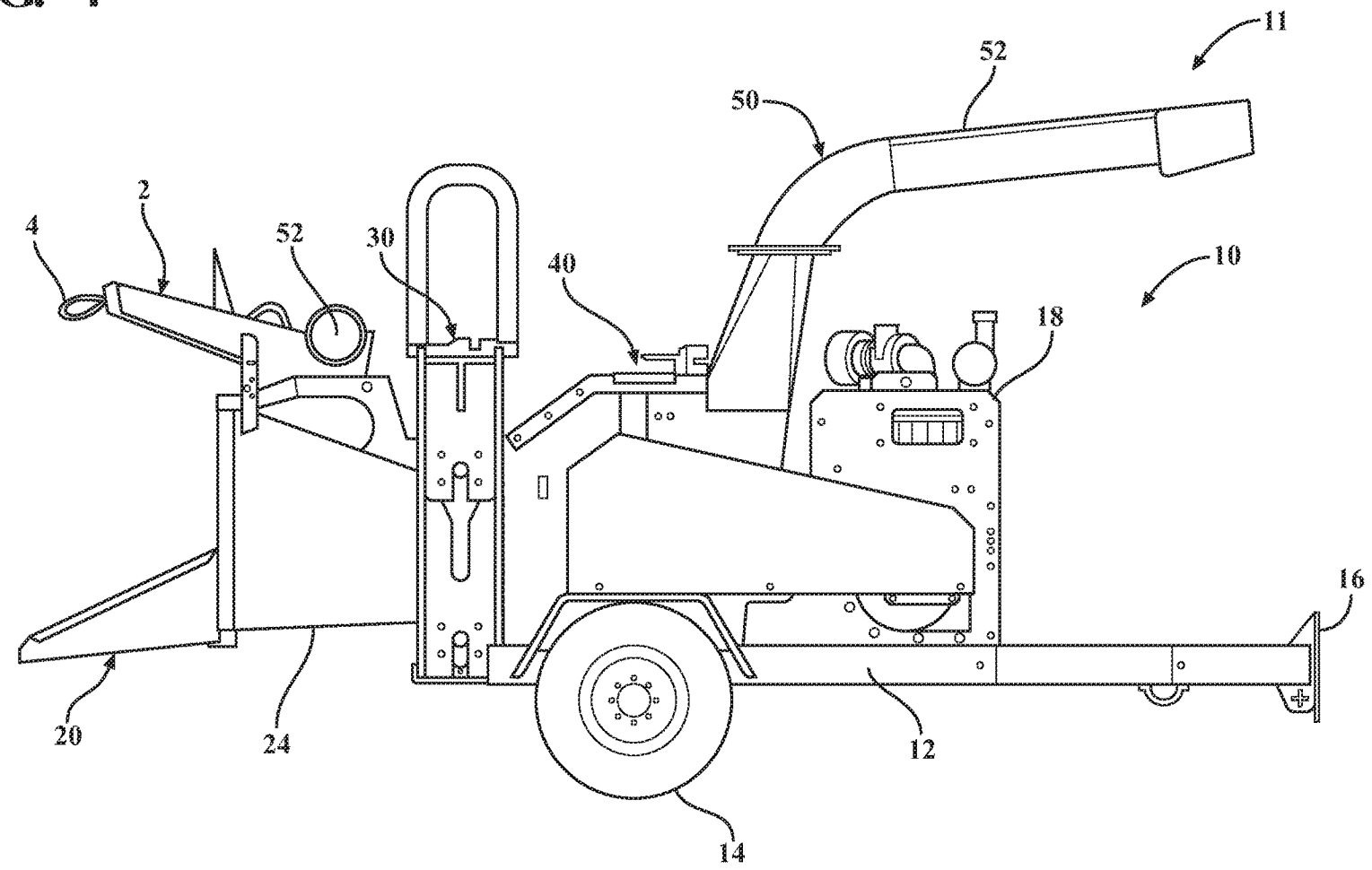
FIG. 4 is a side view of a wood chipper according to one embodiment of the present invention.

For purposes of description herein, the terms "upper", "lower", "right", "left", "rear", "front", "vertical", "horizontal", and derivatives thereof, shall relate to the orientation illustrated in FIG. 4. However, it is to be understood that the invention may assume various alternative orientations, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Reference will now be made in detail to the present preferred embodiments of the invention, examples of which are illustrated in the accompanying drawings. Wherever possible, these same referenced numerals will be used throughout the drawings to refer to the same or like parts. Like features between the various embodiments utilize similar numerical designations. Where appropriate, the various similar features have been further differentiated by an alphanumeric designation, wherein the corresponding alphabetic designator has been changed. Further, the dimensions illustrated in the drawings (if provided) are included for purposes of example only and are not intended to limit the scope of the present invention. Additionally, particular details in the drawings which are illustrated in hidden or dashed lines are to be considered as forming no part of the present invention.

As used herein, the term wood and wood products are meant to be used and defined in their broad, general, and ordinary sense, and the terminology is meant to include trees, brush, trunks, stumps, stems, branches, leaves, or the like, or anything else that could otherwise be recycled, reduced, or otherwise processed, and further includes non-naturally occurring or manufactured wood products such as lumbar, pallets, or other manufactured products that could otherwise be recycled, reduced, or otherwise processed, as is generally known within the art.

As used herein, the term waste processing system is meant to be used and defined in its general and ordinary sense. To wit, systems that recycle, reduce, or otherwise process wood products. Included therein are machines that chip, cut, grind, or otherwise reduce wood waste products and include, generally, chippers, shredders, hammer mills, hogs, shredders, grinders, and/or forestry mowers, or the like. Of course, this is not meant to be limiting in any manner and these systems may take on numerous configurations, and may be used for numerous purposes as is generally known within the art.

As used herein, the term primary system is meant to be used and defined in its general and ordinary sense. To wit, the systems of the waste processing machine that are responsible for the primary features and/or operation of the waste processing machine/system. Included therein are the feed system, the cutting system, and the power supply, source, or engine. Of course, this is not meant to be limiting in any manner and these systems may take on numerous configurations, and may be used for numerous purposes as is generally known within the art.

For the most part hereinafter we will limit our discussion of the invention as related to a wood chipper. However, the inventive embodiments disclosed herein are not meant to be so limited (unless claimed as such), and the systems, devices, and methods disclosed herein may be utilized on any waste processing machine.

Generally, while waste processing machines and wood chippers are commonly known and regularly utilized to reduce trees, branches, brush, and other bulk wood products into smaller wood chips, if incorrectly operated they can be extremely dangerous.

Accordingly, a need exists for safety devices, systems, and methods that are, among other things, relatively inexpensive, provide for increased safety, and are easily operable. Therefore, safety devices, systems, and methods that solve the aforementioned disadvantages and having the aforementioned advantages is desired and, disclosed herein.

More specifically, a waste processing system according to the present invention incorporates a safety device to stop, separate, or otherwise cut-off a cable that has been inadvertently captured and at least partially wrapped around a rotor of a cutting assembly of a waste processing system. Further, the improvement may be utilized in conjunction with any waste reducing machinery comprising a drum or a rotor for cutting and reducing wood products, whether new or existing (e.g., retrofittable).

It is generally known to utilize cables, ropes, lines, and winches including winch lines (all generally referred to herein as cables or lines) to assist with the feeding of bulk wood products into waste processing systems. These cables are generally used to gather, secure, drag, lift, etc., the bulk wood products onto and into the infeed system for capture by the feed system (if provided) of the waste processing machine. During this gathering and feeding operation, if proper procedures are not followed it is possible for the cables to be captured by, inter alia, one or more of the feed wheels or the rotor assembly. Further, once captured by the rotor assembly, and due to the high speed of rotation thereof, the cables can become quickly entangled with or captured by the rotating rotor assembly and consequently may be quickly wrapped around the rotor assembly (i.e., retracted from outside the rotor assembly). In certain instances, the cable may be retracted or wound around at a speed of over 100 Miles Per Hour (MPH).

As such, the retraction of the cable may be too quick for an operator to react to and is therefore problematic: to wit, when the cable is rapidly retracted from the work area (i.e., the area outside of the chipper), the sudden retraction can cause safety issues. For example, the rapid retraction of the cable can cause the cable, and anything attached thereto, to be uncontrollably flung or whipped around, possibly causing damage or injury to anything or anyone in its path of retraction. Further, if anything is entangled or becomes entangled in the cable either before or during this sudden retraction, it may be rapidly pulled towards the system. As such, it is possible for the system to be damaged by the entangled matter or worse, for an operator to become entangled in the cable and drawn towards and/or into the chipper in such a sudden manner as to have little to no time to react.

As such, the inventive safety device disclosed herein reduces these safety issues as, if the cable becomes entangled, the safety device will automatically cut the cable between the rotor assembly and the safety device as it is being wrapped around the rotor assembly. As such, physical injuries to operators and other bystanders, as well as damage to these waste processing systems, may be averted.

Further, the aforementioned device and system may alternatively to or simultaneously therewith be utilized to reduce the backflow of wood particulate in the cutting chamber (e.g., reduce or prevent the processed particles from flowing back to the cutting chamber entrance) as well as, alternatively to or simultaneously therewith, be utilized to increase the amount of processing that is undergone by the wood particles in the cutting/reducing chamber.

Still further, the aforementioned device and system may alternatively to or simultaneously therewith be utilized to increase the ability of the system to process conformable or pliant wood material such as smaller branches, brush, and the like that otherwise, and primarily due to their pliancy, can be problematic in being reduced as well as, alternatively to or simultaneously therewith, be utilized to increase the amount of processing that is undergone by the conformable wood particles in the cutting/reducing chamber.

Therefore, and while not meant to be limiting in any manner, it is envisioned that this system may offer the following advantages: The devices, systems, and methods disclosed herein may be designed to be simple and mechanical in nature and therefore are more reliable and less prone to the failure than more complex systems; the devices, systems, and methods may be designed to be automatic and require no operator intervention to work or engage. For example, in one embodiment the system comprises a simple knife system disposed across a drum style rotor which automatically cuts any cable upon accidental capture via the rotor; the devices, systems, and methods may also assist with reducing the backflow of wood particles; the devices, systems, and methods may also assist with reducing conformable wood products; and in another embodiment, the devices, systems, and methods are retrofittable, expandable, or otherwise usable on existing waste processing systems; and yet further in another embodiment, more than one of these devices and systems can be utilized within the cutting or reducing chamber to increase safety, efficiency, or otherwise promote higher productivity.

Figure 1:
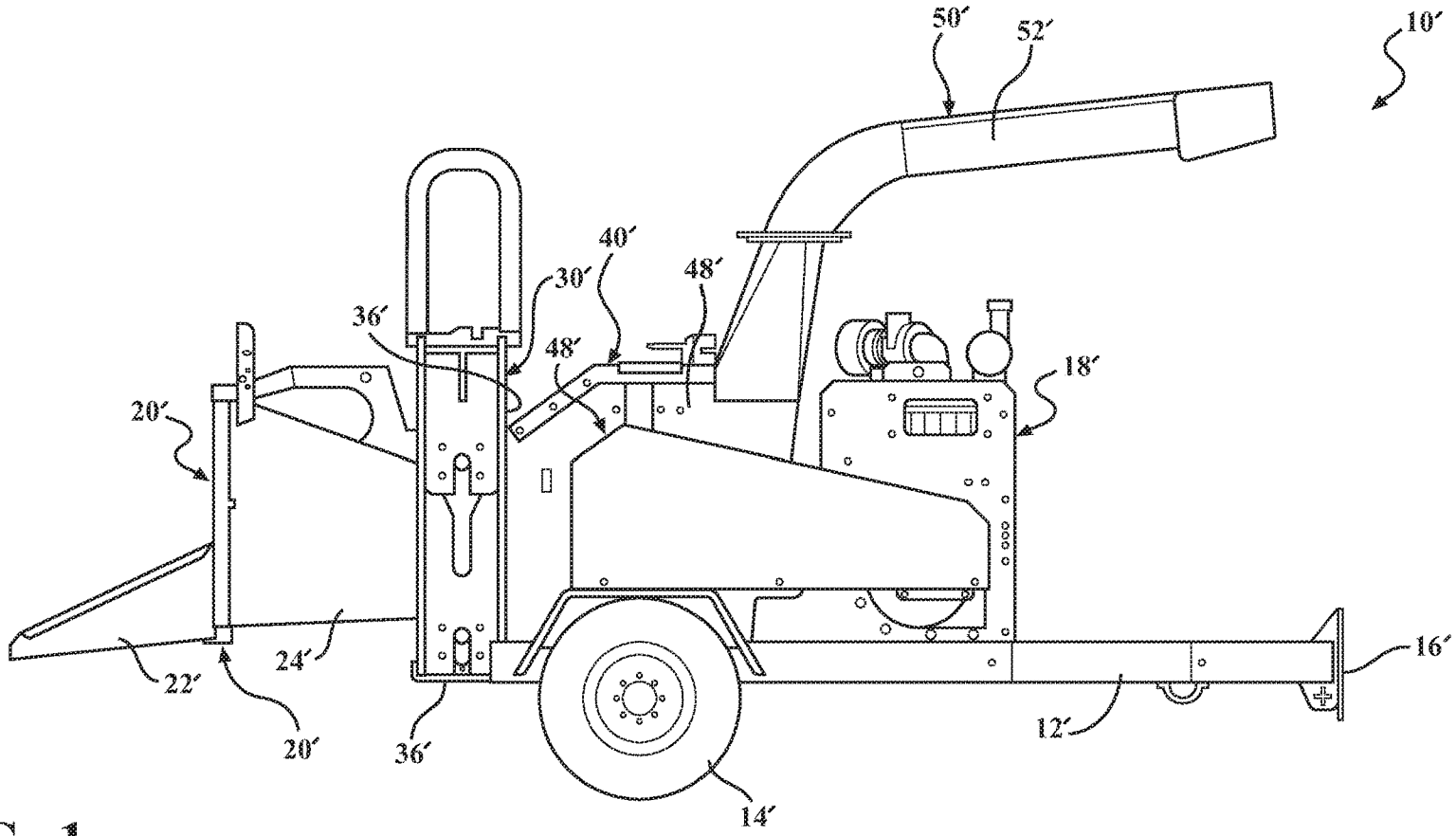
FIG. 1 PRIOR ART
FIG. 1 is a side view of a prior art wood chipper.

Referring now to the drawings and to FIG. 1 in particular, a prior art waste processing machine 10 comprises a wood chipper shown generally at 10' and includes a frame 12' supported by a pair of wheels 14', a conventional trailer hitch 16' to allow the chipper to be towed by a vehicle (not shown), and a power source 18'. Supported on frame 12', the wood chipper 10' includes: an infeed assembly or system 20' comprising an infeed tray 22' and an infeed chute 24' to allow wood material to enter the wood chipper; a feed system 30' comprising a feed wheel assembly (not shown), the feed wheel assembly typically comprising at least one feed wheel (not shown) and one or more feed wheel housings 36', disposed between the infeed system 20' and the cutting system 40', to feed wood material to the cutting system; the cutting assembly or system 40' is spaced from the feed system 30' and comprises cutters (not shown) and a cutting assembly housing 48'; and a discharge assembly 50' comprising a discharge chute 52'.

The power source 18' typically comprises an internal combustion engine and provides rotational energy to both the feed wheels (not shown) of the feed system 30' and the cutting disc or drum (not shown) of the cutting system 40'. The engine 18' operatively couples the feed system 30' and cutting system 40' to cause rotation of the feed wheels (not shown) and the rotatable disc or drum (not shown). The engine 18' is typically operated such that the cutting disc/drum (not shown) rotates at a relatively high velocity, while the feed wheels (not shown) rotate relatively slowly. In operation, trees, brush, and other bulk wood products are fed into the infeed chute 24' and captured between, for example, opposed, rotating feed wheels (not shown) of the feed system 30' which feed, pull, or otherwise cause the bulk wood products to encounter the cutting disc/drum (not shown) of the cutting system 40'. The cutting system then reduces the bulk wood products into chips which are expelled through discharge assembly 50' via the discharge chute 52'.

It will be understood that the wood chipper 10 may comprise any suitable waste reducing machinery such as the trailerable wood chipper as seen in FIG. 1 or any other movable or stationary machinery used to chip, grind, cut, or otherwise reduce bulk products. While one preferred embodiment incorporates a pair of opposed, horizontally aligned feed wheels, it is also to be understood that any feed system can be incorporated into the invention, or none at all. It will be further understood that this application describes the structure and operation of the feed wheels with respect to hydraulic systems, but that the feed wheels may be powered by any other suitable method. Further, while the preferred embodiment incorporates an internal combustion engine, the wood chipper can be powered by any other suitable methods including, but not limited to, electricity, gas, diesel, or a power take-off from an auxiliary power source without departing from the scope of this invention.

Figure 2:
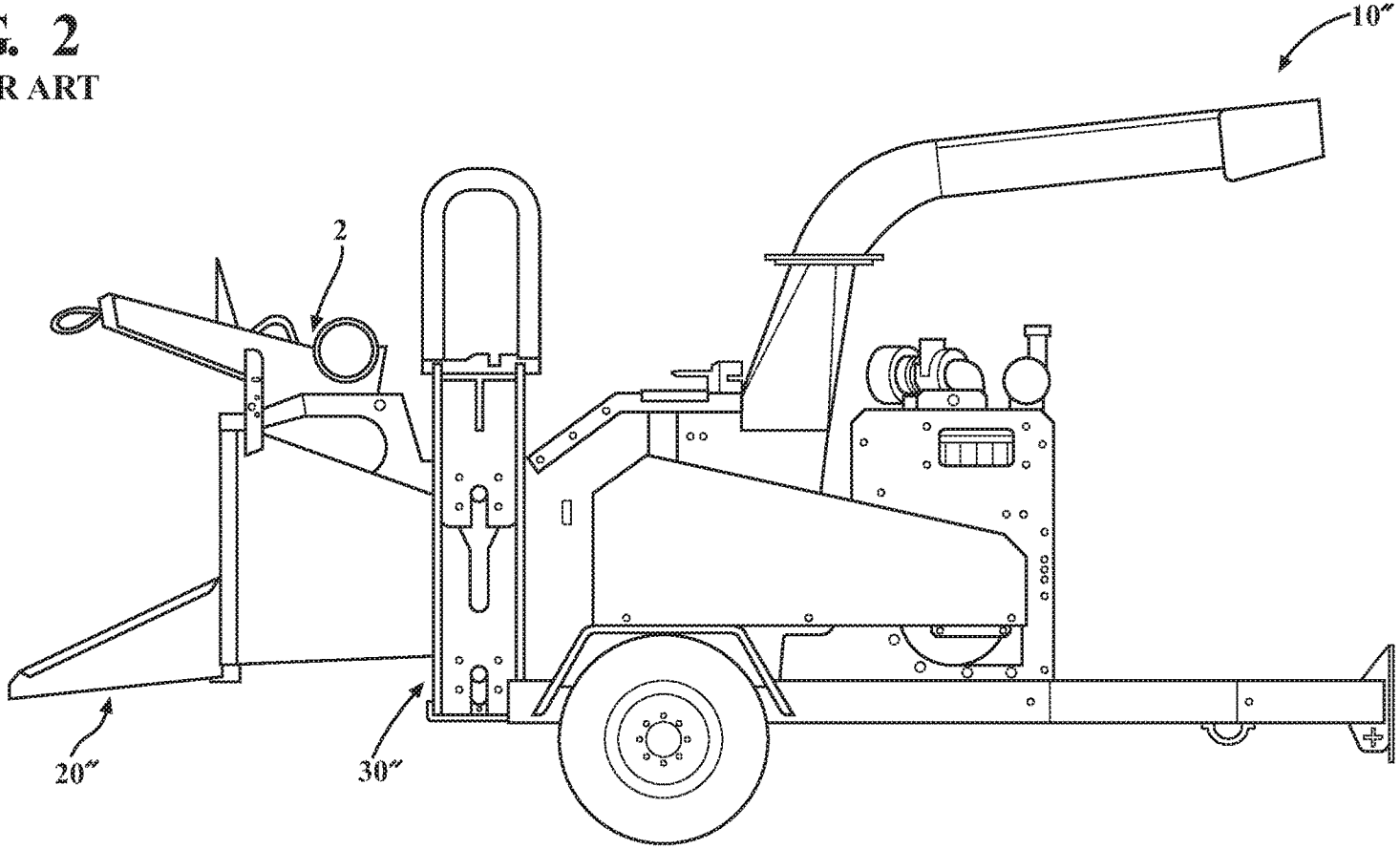
FIG. 2 PRIOR ART
FIG. 2 is a side view of another prior art wood chipper.
Figure 3:
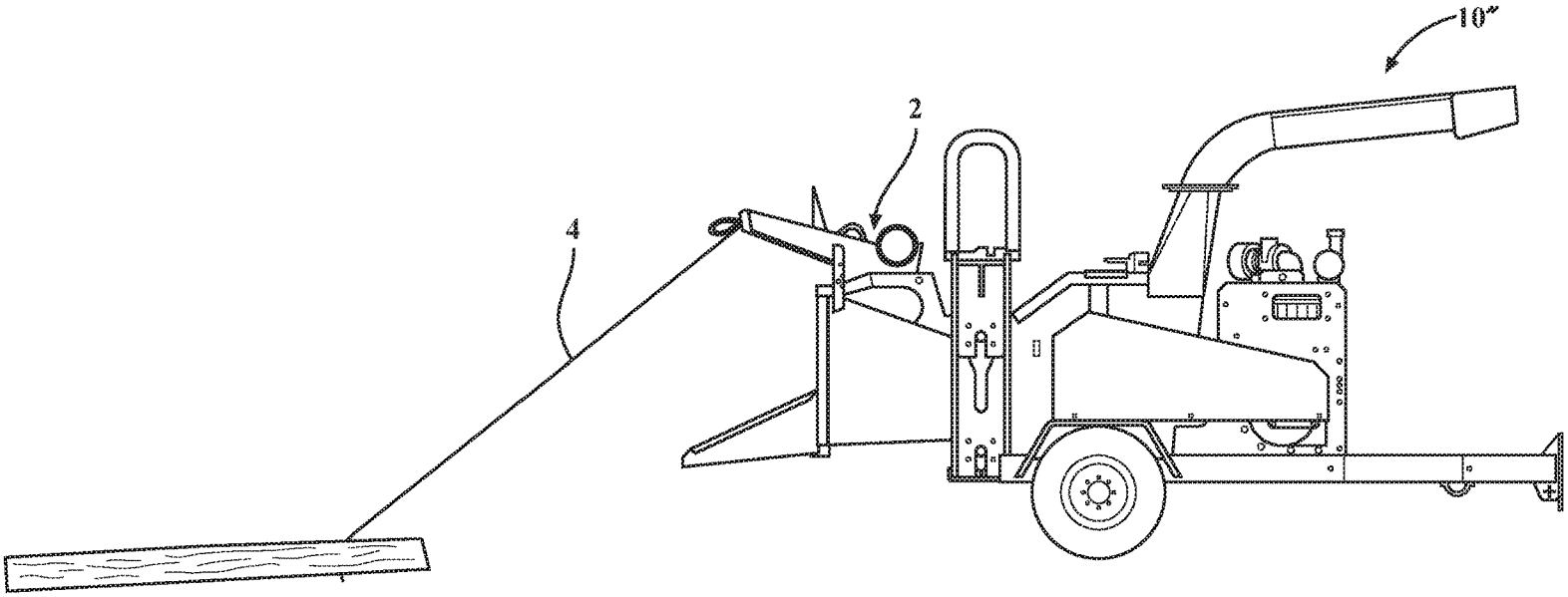
FIG. 3 PRIOR ART
FIG. 3 is a side view of a prior art wood chipper utilizing feed cables.

FIG. 2 illustrates another prior art waste processing system 10 comprising a wood chipper shown generally at 10" which is similar to chipper 10' but also includes a winch 2 for assisting with the feeding of the bulk wood products to the infeed system 20" and feed system 30". FIG. 3 illustrates the chipper 10" with the winch 2 being used to assist the feeding operation.

As disclosed herein-above, when a cord, rope or other cable 6 is used to assist the feeding process (as is known in the art), whether alone or in combination with a winch 2 and a winch line 4, if operated improperly the cable 6 or winch line 4 may become entangled within the feed wheel assembly and/or the cutting system. Further, when such a cable becomes entangled within the cutting system, due to the high rate of speed at which the cutters rotate, the cable can become entangled, wrapped around the cutters, and pulled or retracted from the work area in very short order. This is problematic as when the cable is rapidly wound around the cutters and thereby rapidly retracted from the work area (i.e., the area outside of the chipper), the sudden retraction can cause a dangerous whipping of the cable, as well as pull into the chipper anything caught in or by the cable. As such, it is possible for the waste reducing system to be damaged thereby. It may also be possible for the operator of the chipper to be injured by the whipping action or worse, become entangled in the cable and drawn towards and/or into the chipper in such a quick manner as to have little to no time to react.

The disadvantages and drawbacks of the prior art are overcome through the waste processing system of the present invention, wherein preferred embodiments are disclosed in FIGS. 4-16. Referring now to FIG. 4, one embodiment of a waste processing system comprises a wood chipper shown generally at 10 and includes a frame 12 supported by a pair of wheels 14, and a trailer hitch 16 in order to allow the waste processing system to be transported by a vehicle. Supported on the frame 12 are an infeed assembly 20, a feed system 30 spaced therefrom, a cutting assembly 40 spaced therefrom, and a discharge system 50. A power system 18, typically comprising an internal combustion engine, is also mounted on frame 12 to provide power to both a feed system 30 and the cutting assembly 40. The chipper 10 may also include winch assembly 2.

It is to be appreciated that while a wood chipper is shown and described herein, the waste processing system is not to be limited to a wood chipper and may comprise any system that is adapted to reduce bulk wood products via, inter alia, a cutting or reducing system comprising a rotating drum style cutting, reducing, or chipping apparatus.

FIGS. 5-8 illustrate an exemplary cutting assembly of a waste processing system 10 comprising a rotatable cutting assembly 40 spaced from the infeed assembly 20 and operatively disposed within a casing, enclosure, frame or housing 48, the housing defining a cutting or reducing chamber 60. The cutting assembly 40 also comprises a rotor assembly 42 rotatably mounted to a support member 62, the support member operatively connected to the housing 48 so as to rotate therein. The rotor assembly also comprises a drum type rotor 44 comprising an outside surface 66, and at least one reducing member 68 mounted to the rotor so as to extend from the outside surface 66 by a distance L (FIG. 6) and thereby being adapted to reduce bulk wood products when the rotor assembly 42 is rotated and the reducing members 68 contact the bulk wood products fed thereto. As illustrated in FIG. 7A, a first safety device 100 is disposed within the cutting chamber 60 and spaced from a first edge 70 of reducing member 68, the spacing defining a first gap 72 through which a cable, cord, or line 6 that has been captured and at least partially wrapped around rotor assembly 42 is cleaved, cut, damaged, scored, nicked, or separated between the first safety device 100 and the edge 70 of reducing member 68 when the cable 6 is disposed between the first gap 72. A characteristic feature of safety device 100 is the gap 72, which may be provided through numerous embodiments including, inter alia, a simple elongated bar, channel, anvil, knife, cutter, shear-head, cutting assembly, or any other fixture creating or otherwise providing said gap. Further, it is to be understood that cable 6, as used herein, may be any cable, line, cord, or the like that is capable of being wrapped around the cutting assembly 40, for example, when utilizing the cable 6 to assist with the feeding process, and includes any winch line 4 when a winch 2 is utilized.

Figure 5:
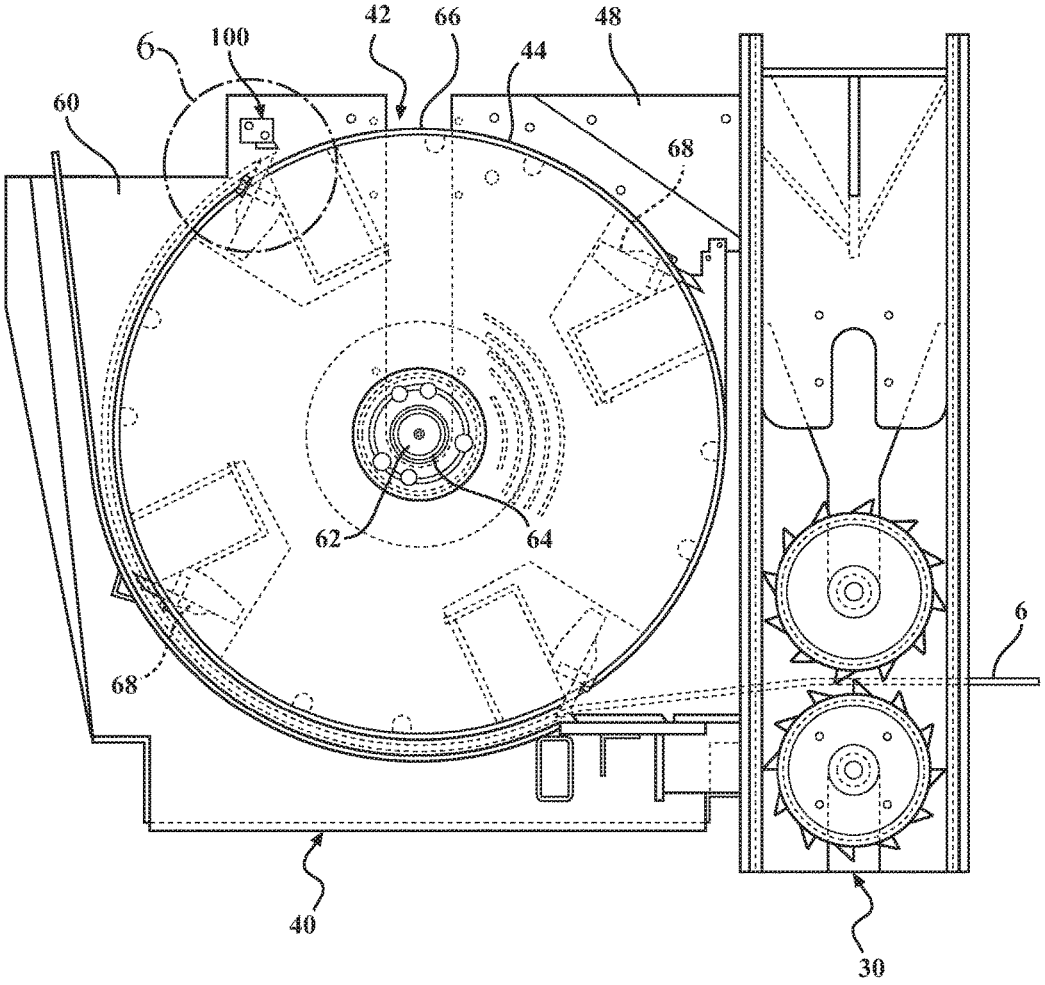
FIG. 5 is a partial sectional side view of a cutting assembly of a waste processing system according to one embodiment of the present invention and illustrating a first safety device.
Figure 6:
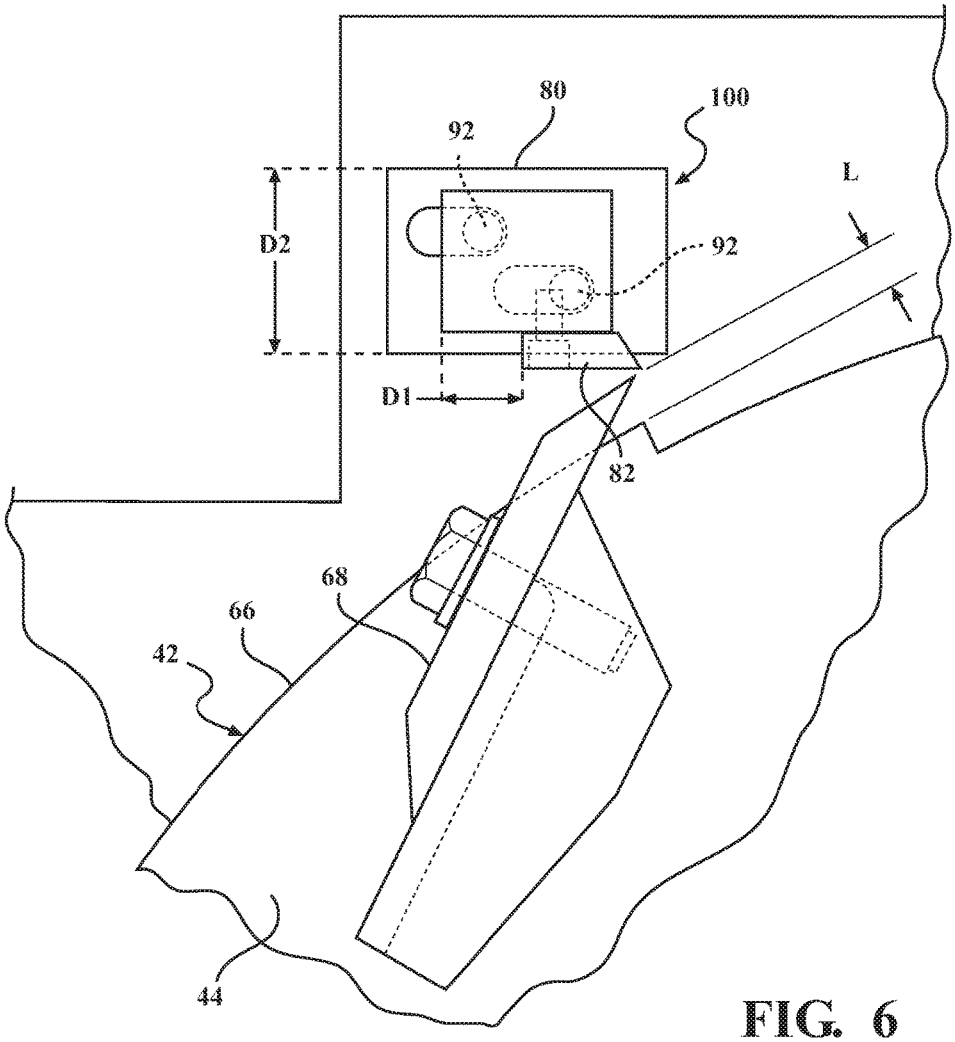
FIG. 6 is an enlarged partial sectional side view of the first safety device of FIG. 5.
Figure 7A:
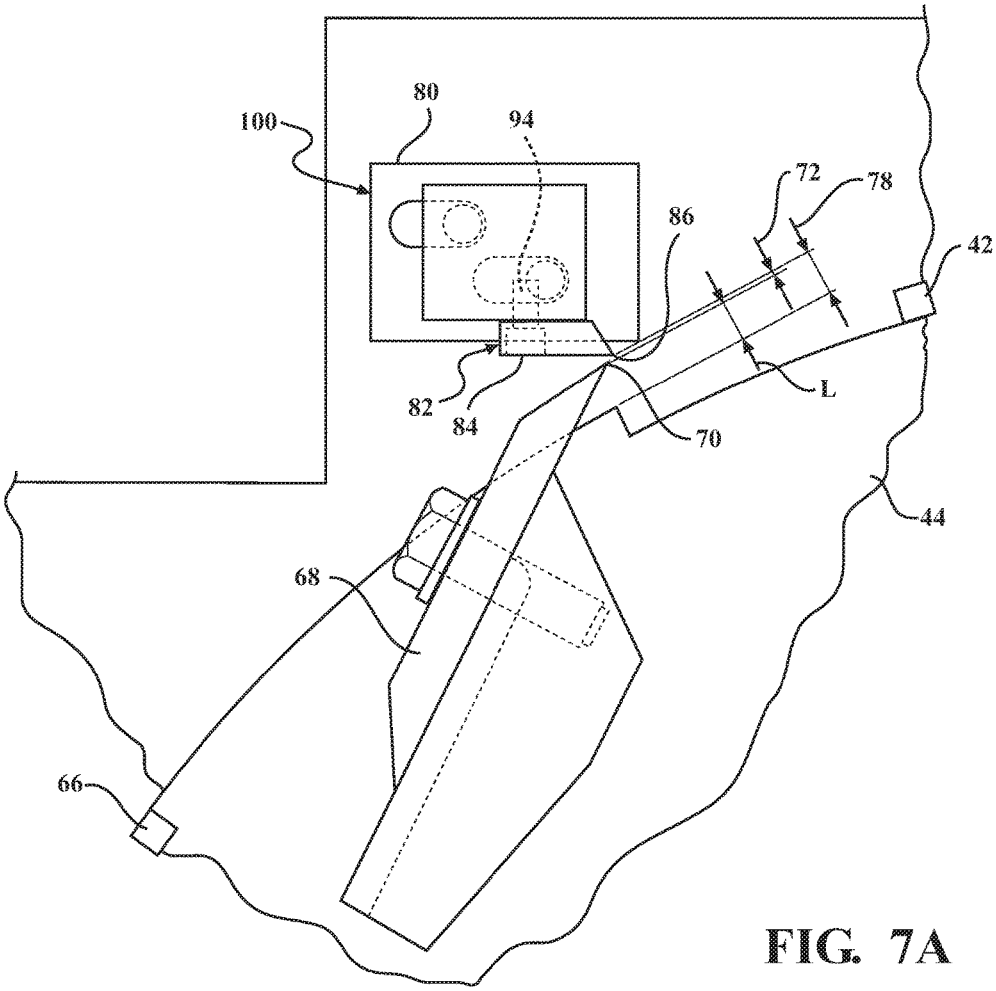
FIG. 7A is an enlarged partial sectional side view of the first safety device of FIG. 5.
Figure 7B:
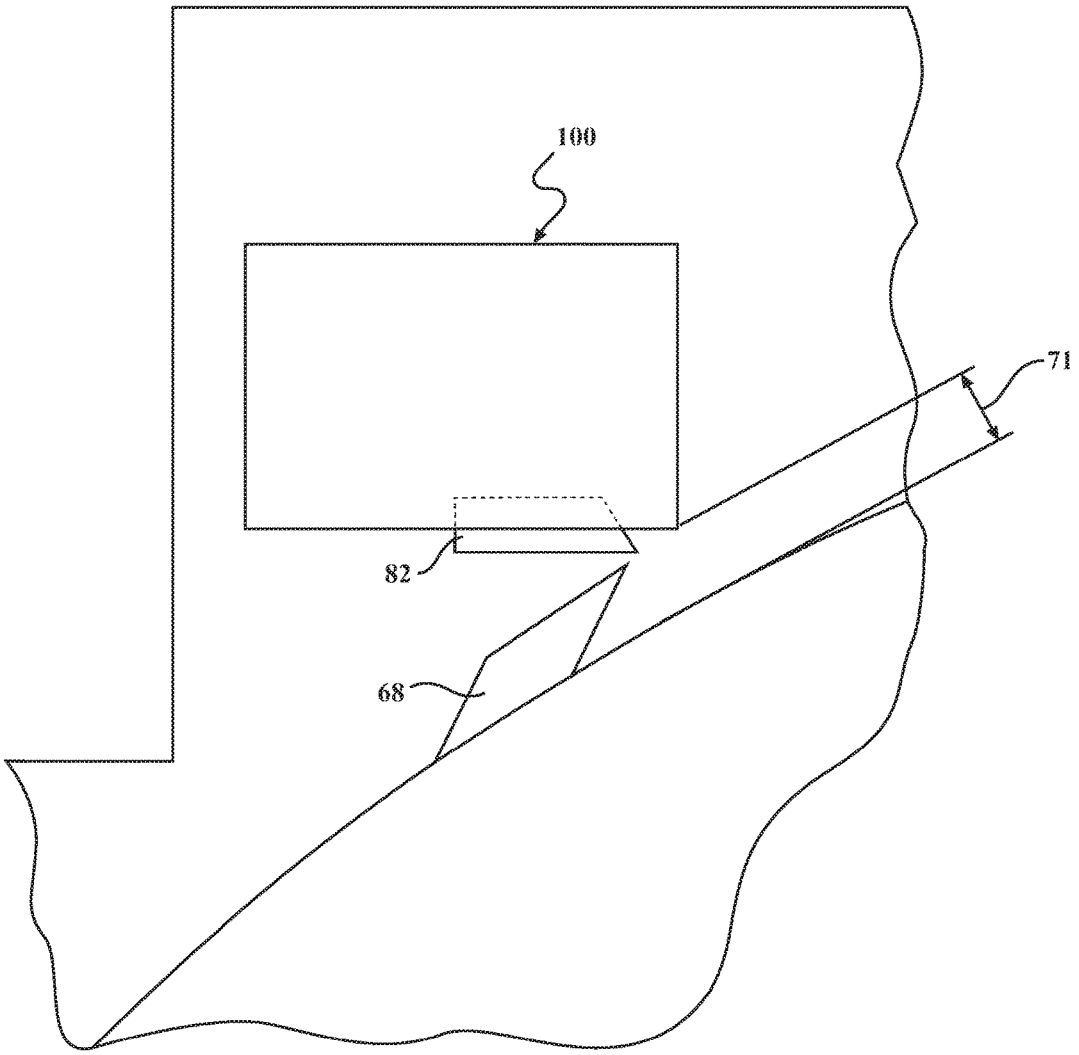
FIG. 7B is an enlarged partial sectional side view of the first safety device of FIG. 7A.
Figure 8:
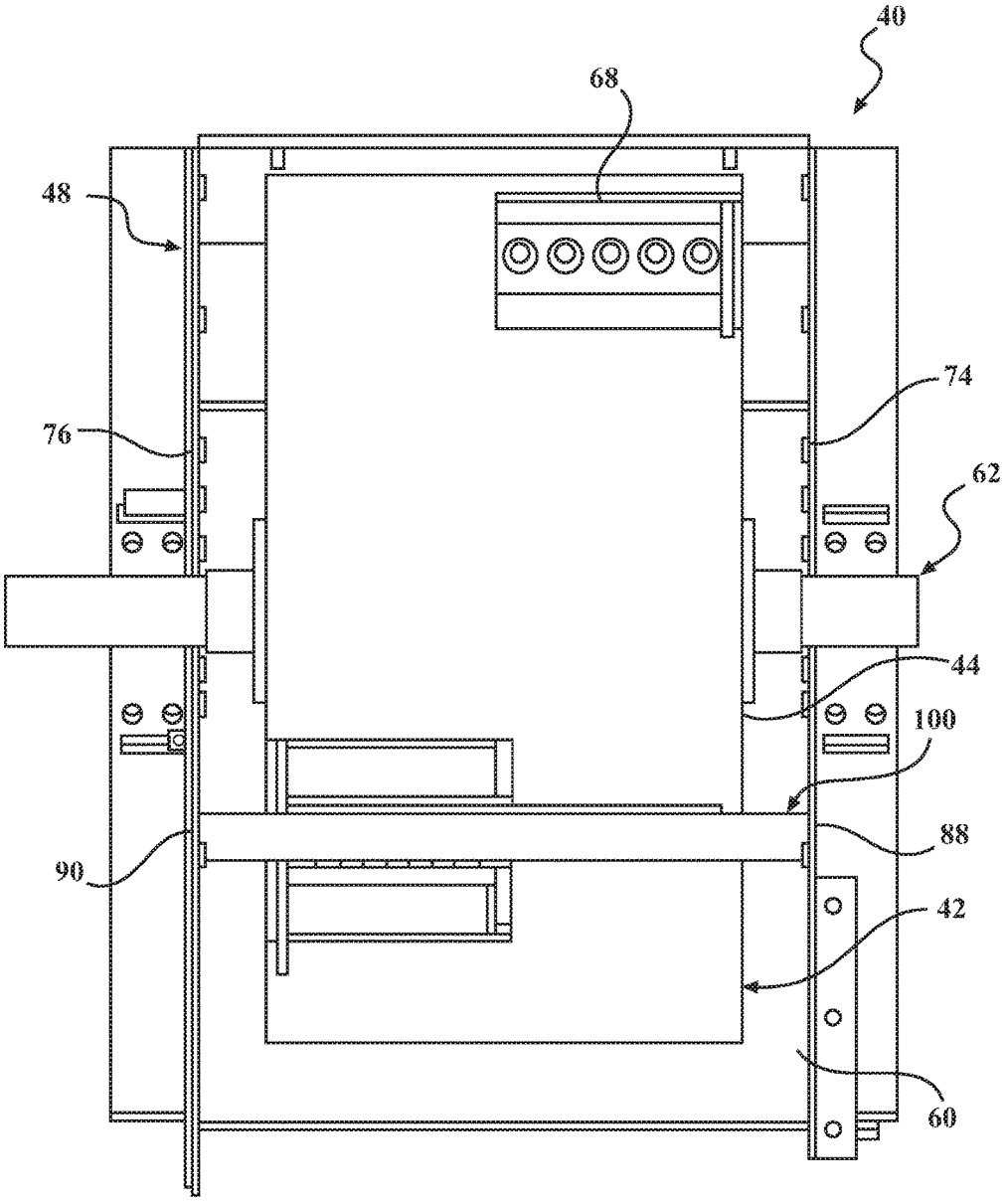
FIG. 8 is a top sectional view of the cutting assembly of FIG. 5.
Figure 9:
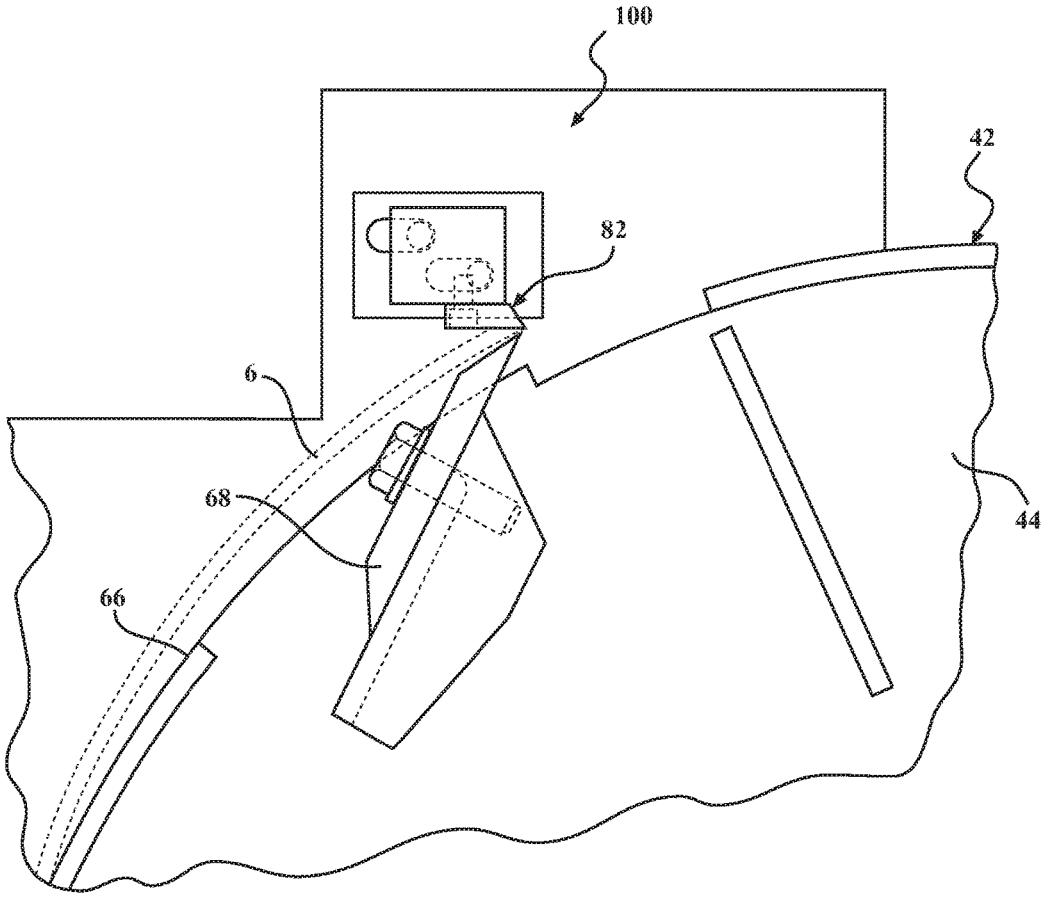
FIG. 9 is an enlarged partial sectional side view of the cutting assembly of FIG. 5 and illustrating a cable being cut.
Figure 10A:
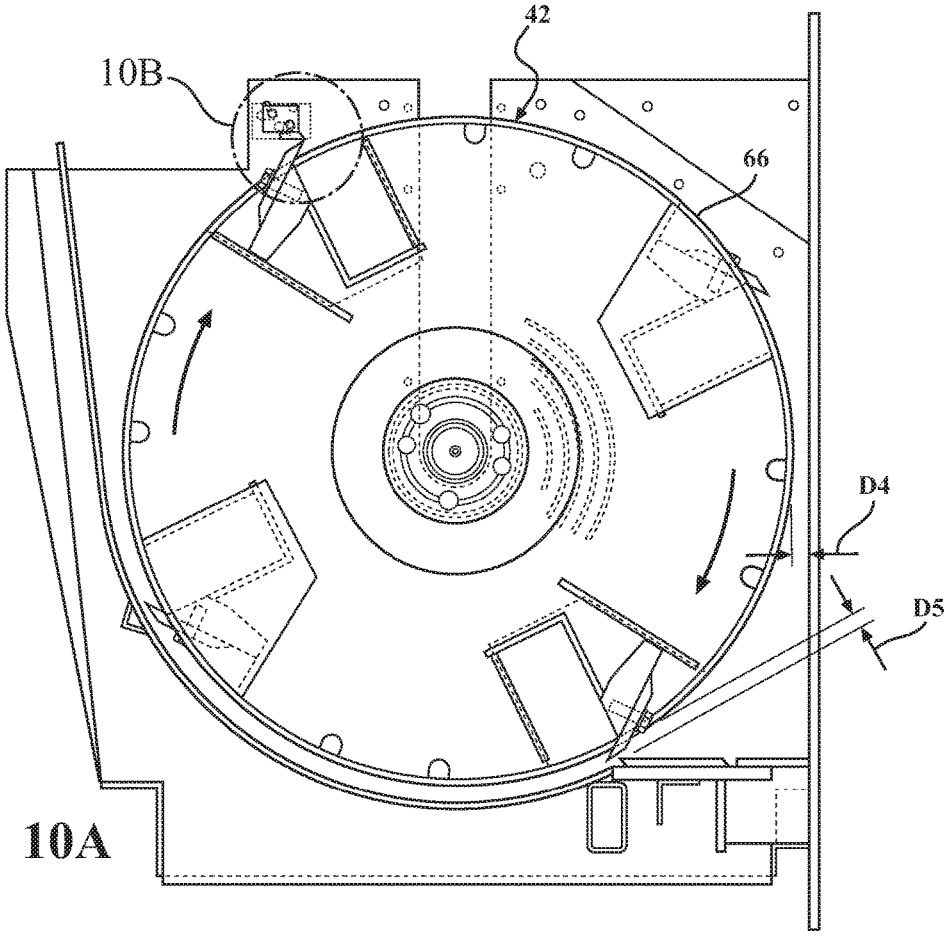
FIG. 10A is a partial sectional side view of a cutting assembly of a waste processing system according to another embodiment of the present invention.
Figure 10B:
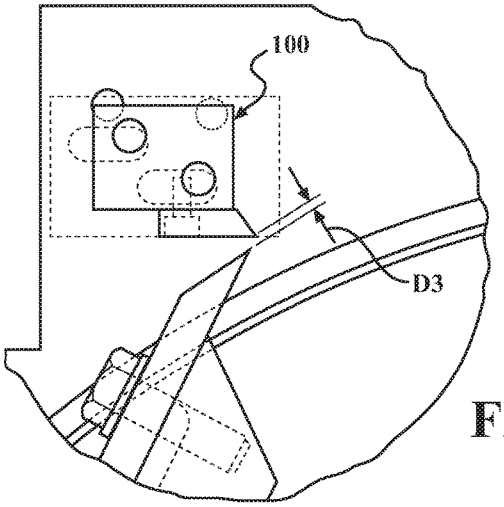
FIG. 10B is an enlarged partial sectional side view of the cutting assembly of FIG. 10A.

As illustrated in FIGS. 5 and 8, rotatable cutting assembly 40 may comprise a rotor assembly 42 which is mounted to a support member 62 which is rotatably mounted within housing 48 in any known manner. For example, support member 62 may comprise an axle 64 which is rotatably disposed between and supported by first and second sides or walls 74, 76 of housing 48 (FIG. 8). In this manner, rotor assembly 42 may be rotated within the cutting or reducing chamber 60 of housing 48. The cutting assembly 40 may also include a drum style rotor 44.

As discussed herein, as with most powered rotating devices, when the rotor 44 is powered and rotating, it may be possible when proper safety precautions are not followed, for the rotor 44 to capture, entwine, entangle, or otherwise wind the feeding cords 6 around the circular rotor 44 during operation (e.g., when rotating).

In order to reduce bulk wood products, the rotor assembly 42 includes at least one reducing member 68 which is mounted to the rotor 44 so as to extend from the outside surface 66 by a distance L. For example only, in a wood chipper this distance may be 0.625 inches (⅝"). However, this distance may be adjusted in order to vary the size of the wood chips produced by the reducing member 68. Further, the reducing member 68 will typically comprise a first edge 70 which is sharpened (e.g., a knife edge) such that the reducing process is more effective.

As best illustrated by FIG. 8, cutting system housing 48 operatively encloses rotatable cutting assembly 40 and comprises any casing, enclosure, frame or housing 48, wherein the interior of the housing 48 defines a cutting or reducing chamber 60 wherein the rotor assembly 42 operatively reduces bulk waste wood products. Housing 48 also includes a first side wall 74 and a second side wall 76 which, in this particular embodiment, support rotor assembly 42, via support member 62, and in this case a horizontally disposed axle 64 which is rotatably mounted within housing 48 to side walls 74 and 76.

Illustrated by FIGS. 5-8 is a first embodiment the first safety device 100 which comprises a first safety device fixture or support 80 which, in this embodiment, is operatively connected to and disposed between the first and second sides 74, 76 of housing 48, wherein support 80 includes a support first end 88 connected to first wall 74 and a support second end 90 connected to second wall 76, thereby disposed, supported, and extending between first and second wall 74, 76, and extending across (e.g., transverse to the direction of rotation of rotor 44) and spaced from rotor 44 by a (second) gap 71. Support member 80 may be mounted to housing 48 in any known manner and in the embodiment depicted is mounted via screws (not shown) and through apertures 92 disposed in housing side walls 74, 76. Further, support 80 may be adjustably mounted within sidewall 74, 76 in any known manner such that the support 80 may be adjusted in a horizontal direction D1 and a vertical direction D2. Also disposed on support 80 is an edge, knife, or cutter 82 which includes a second edge 86. In this embodiment cutter 82 comprises a knife 84 with a sharpened second edge 86. Cutter 82 may be mounted to support 80 in any known manner and in the embodiment depicted is mounted via screws (not shown) and through apertures 94 disposed in support 80. Further, cutter 82 may be adjustably mounted within support 80 in any known manner such that the cutter 82 may be adjusted in a horizontal direction D1 and a vertical direction D2.

As illustrated by FIGS. 7A-9 cutter 82 is typically mounted adjacent rotor 44 such that a first distance, spacing, or first gap 72 between first edge 70 of reducing member 68 is spaced (in this particular case uniformly, though not required) between second edge 86 of cutter 82, this spacing thereby defining the first gap 72 through which a cable, cord, or line 6 that has been captured and at least partially wrapped around rotor assembly 42 is cleaved, cut, or otherwise separated between the first edge 70 and the second edge 86 when the cable 6 is adjacent and/or disposed between the first gap 72. However, the cable 6 may be cleaved between the second edge 86 and one or both of the outside surface 66 of rotor 44 and first edge 70 of reducing member 68. For example, when the first safety device 100 is disposed within the cutting chamber 60 and spaced from an outside surface 66 of rotor 44, the spacing defining a third gap 78, while cable 6 may be severed between first gap 72, the cable 6 may also be partially or fully severed between the third gap 78, between first device 100 and the outside surface 66 of rotor 44, when the cable 6 is disposed between the third gap 78.

Further, as described herein-above, this first gap 72 may be adjustable. The first gap may be sized according to the cable 6 that is being used. However, and again for this particular embodiment only and for example only, the first gap 72 may range from 0.0 inches to 1.0 inch, preferably from 0.01 inches to 0.5 inch, and more preferably from 0.0625 inches to 0.250 inch, and in one particular embodiment, the first gap is 0.125 inches (⅛").

Therefore, the distance between a first edge 70 of the reducing member 68 and the second edge 86 of the first safety device 100 defines a first gap or cutting zone 72, wherein any object entrained and/or wrapped about the rotor 44 and passing through the cutting zone 72 is cut, sheared, or pinched off by at least one of the first and second edges 70, 86.

In another embodiment and for example only, the second edge 86 of first safety device 100 may be uniformly spaced from a first edge 70 of at least one of the plurality of reducing members 68, defining a first gap 72 therebetween, such that the first gap 72 is less than the distance L (e.g., a second distance) the first edge 70 of the reducing member 68 extends from the rotor 44 (e.g., the gap 72 is less than the gap L).

In yet another embodiment, the first gap 72 may be defined as a range dependent upon the size of the rotor 44. Again, and for this particular embodiment only, the first gap may range from 0.0% to 1.0% of the size (e.g., diameter) of rotor 44, preferably from 0.0% to 0.5%, and more preferably from 0.1% to 0.4%, and in one particular embodiment, the first gap is 0.3%.

Of course, the above mentioned ranges are for descriptive purposes and not meant to be limiting in any manner, unless so specified in the claims and then, limited only to those respective claims.

In still another embodiment (FIG. 10A), the first gap 72 comprises a third distance D3 which is less than any other fourth distance or clearance D4 between an outside surface 66 of the rotor assembly 42 and any other surface, obstruction, or clearance disposed within the cutting chamber 60 and parallel to the outside surface 66 of the rotor assembly 42. In yet a further embodiment, the first gap 72 comprises a third distance D3 which is less than any other fifth distance D5 between an outside surface 66 of the rotor assembly 42 and any other device (i.e., spacing or clearance) disposed between the first and second sides or walls 74, 76 of the housing 48. In still another embodiment, the first gap 72 comprises a third distance or clearance D3 which is less than any other second clearance within the housing, between the outside surface 66 of the rotor 44 and any other feature.

Figure 11:
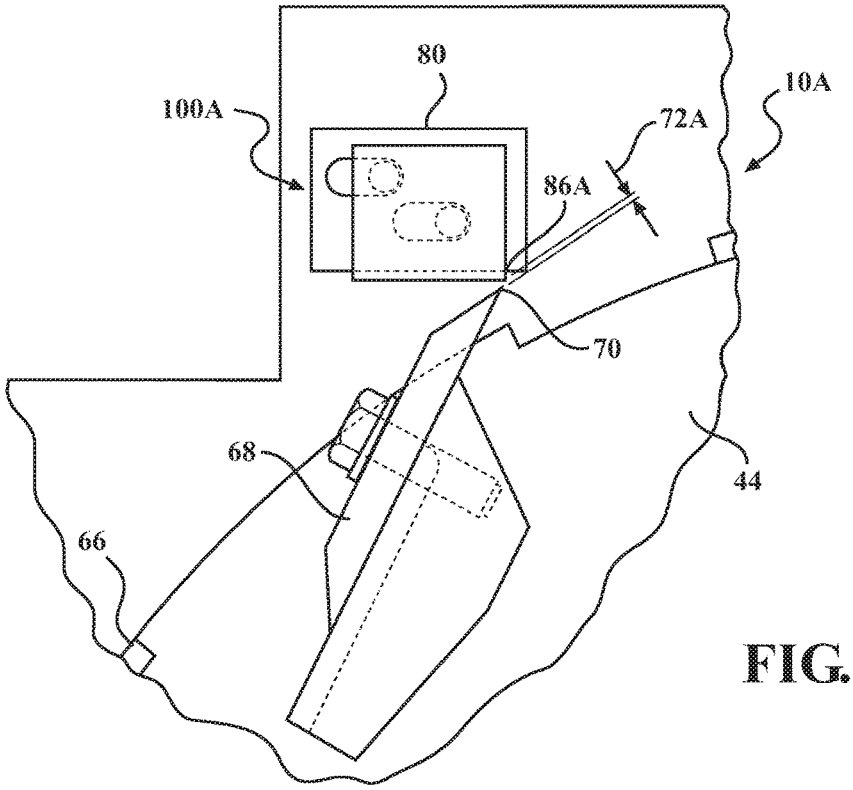
FIG. 11 is an enlarged partial sectional side view of the cutting assembly of another embodiment of the present invention.

FIG. 11 depicts a further embodiment of first safety device 100 wherein embodiment 10A depicts a first safety device 100A wherein second edge 86A comprises an edge of the support member 80 and is disposed from first edge 70 by a first gap 72A.

Figure 12:
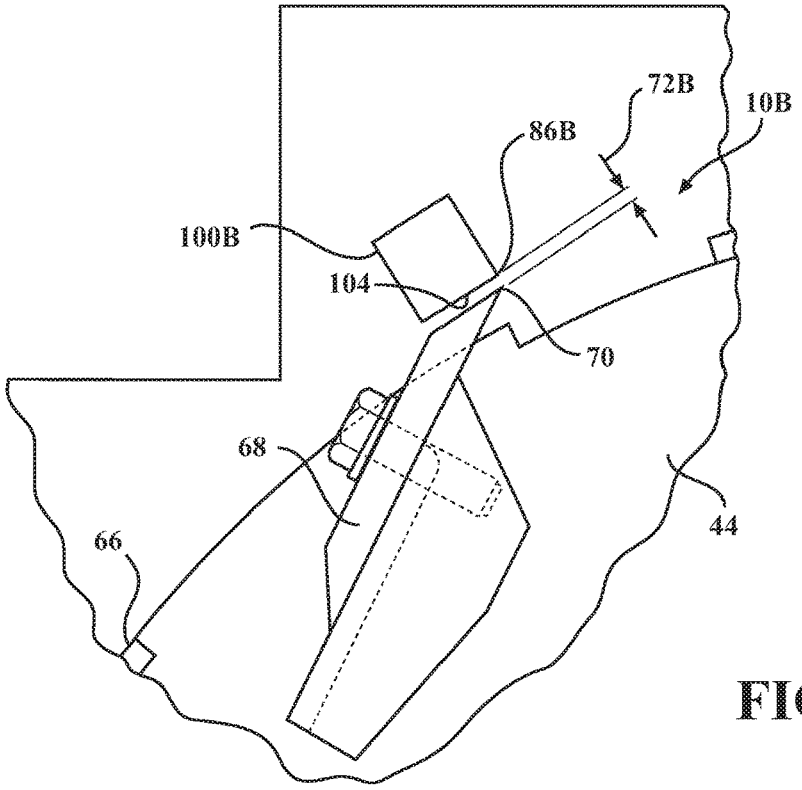
FIG. 12 is an enlarged partial sectional side view of the cutting assembly of yet another embodiment of the present invention.
Figure 13:
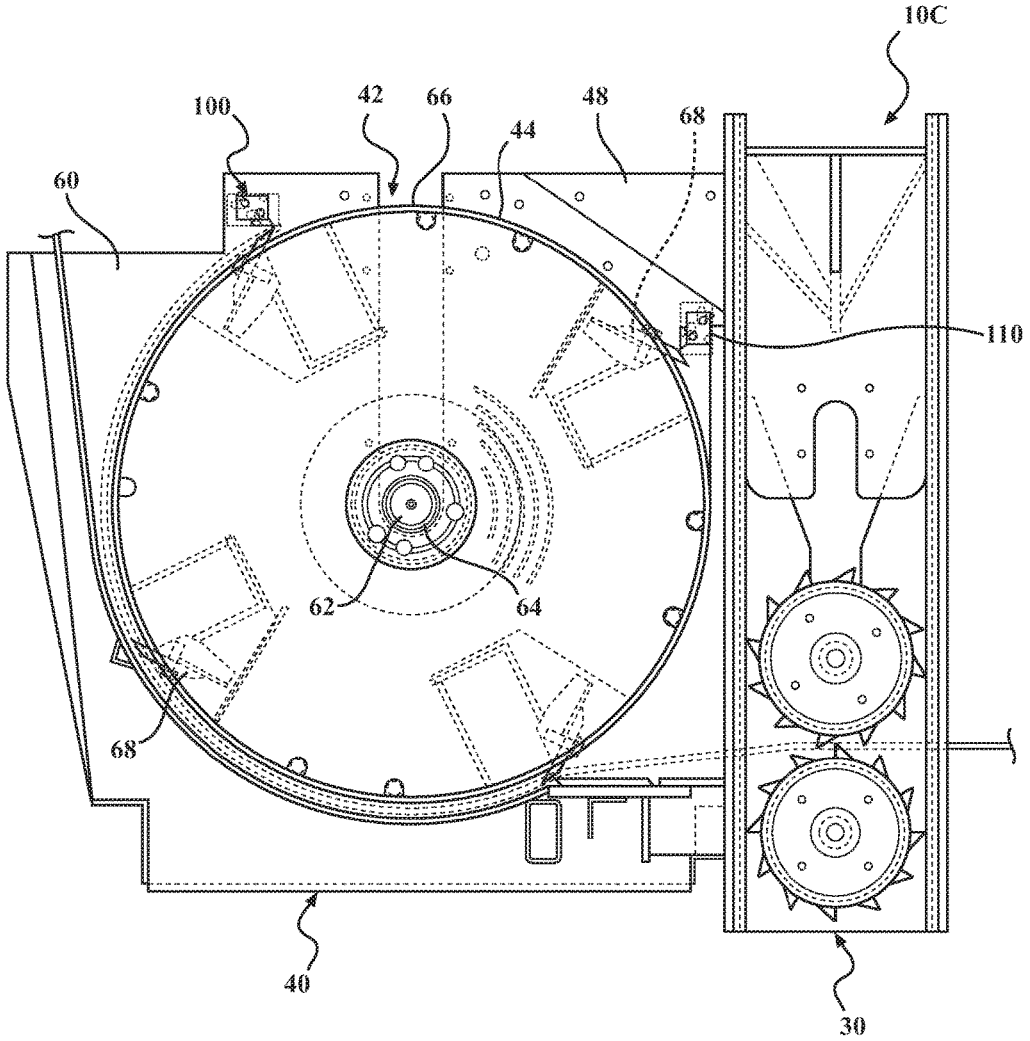
FIG. 13 is a partial sectional side view of a cutting assembly of a waste processing system according to another embodiment of the present invention and illustrating a second safety device.
Figure 14:
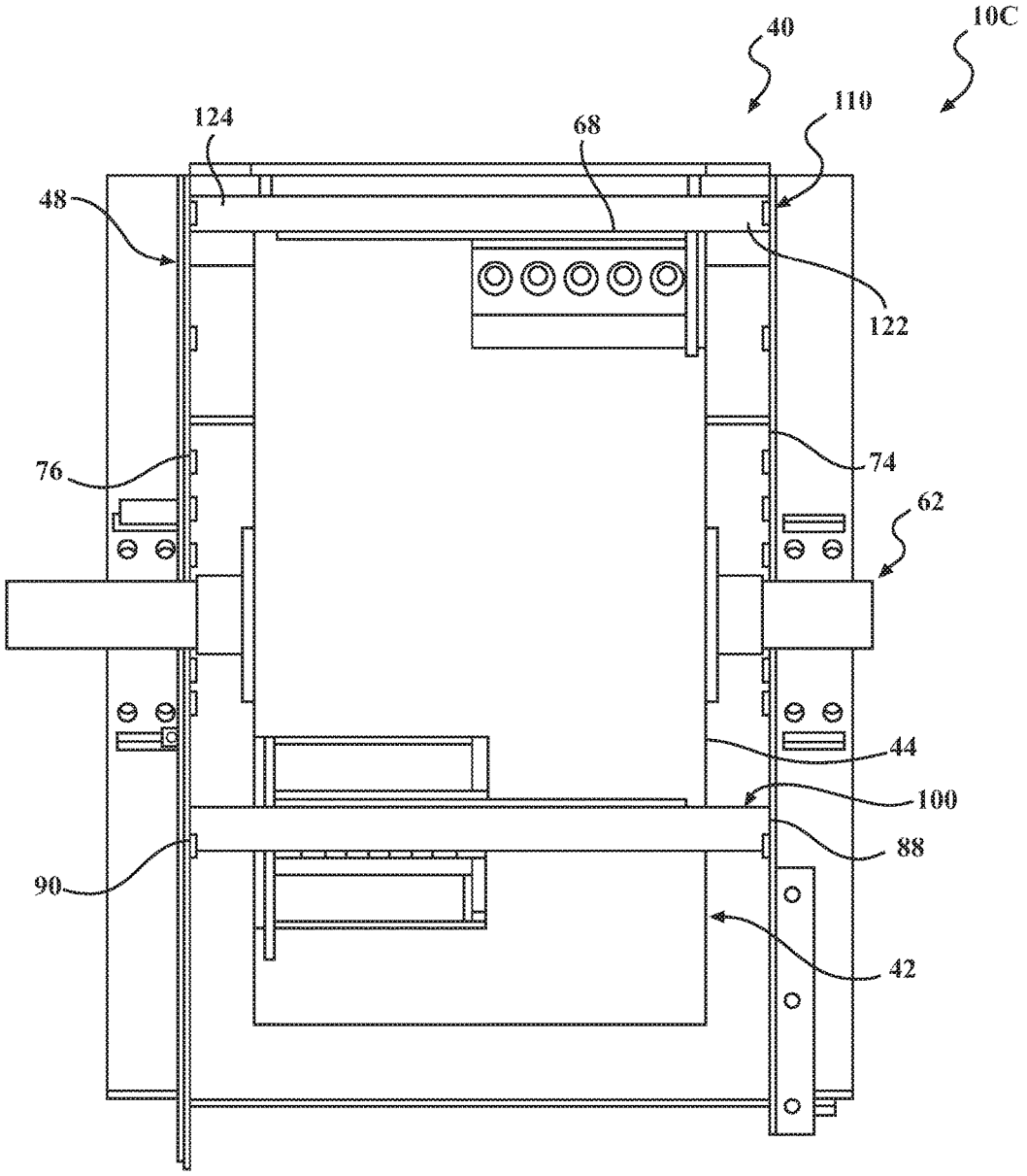
FIG. 14 is a top sectional view of the cutting assembly of FIG. 13.
Figure 15:
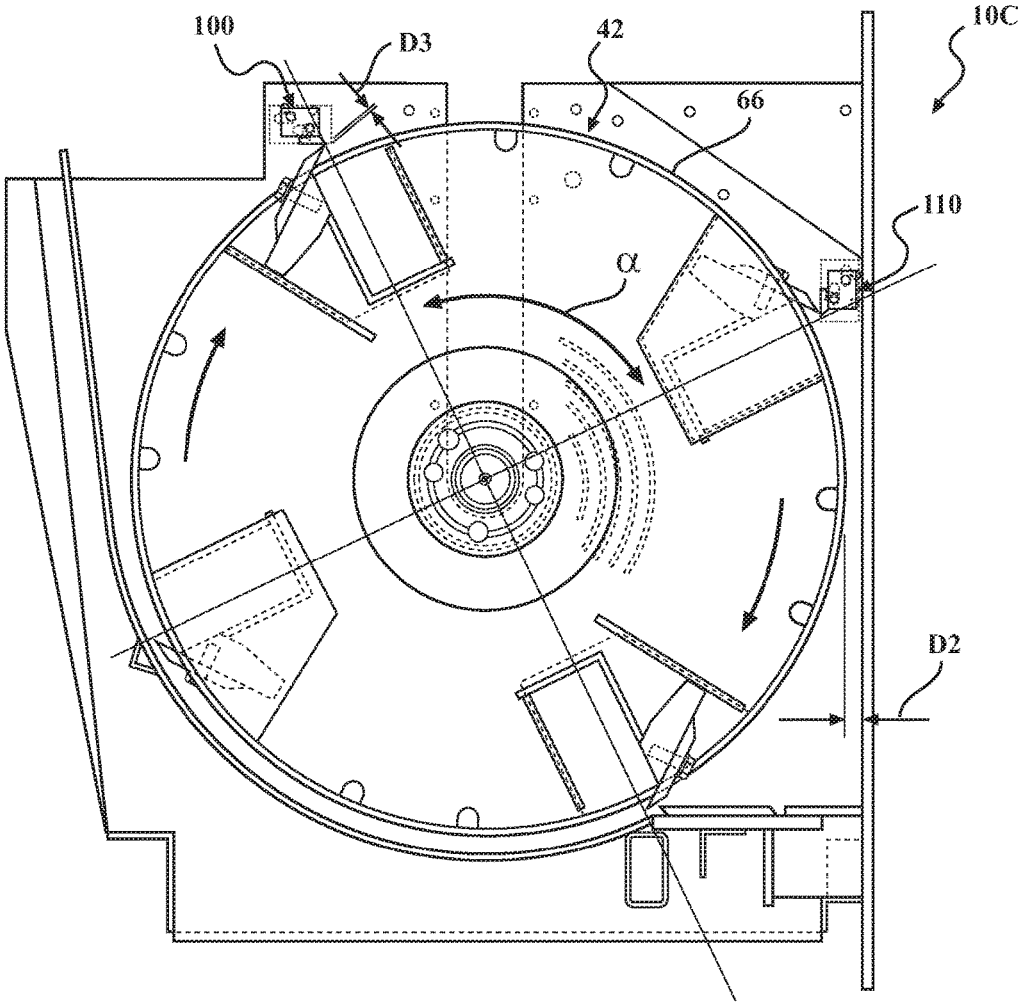
FIG. 15 is a partial sectional side view of the cutting assembly of FIG. 13.
Figure 16:
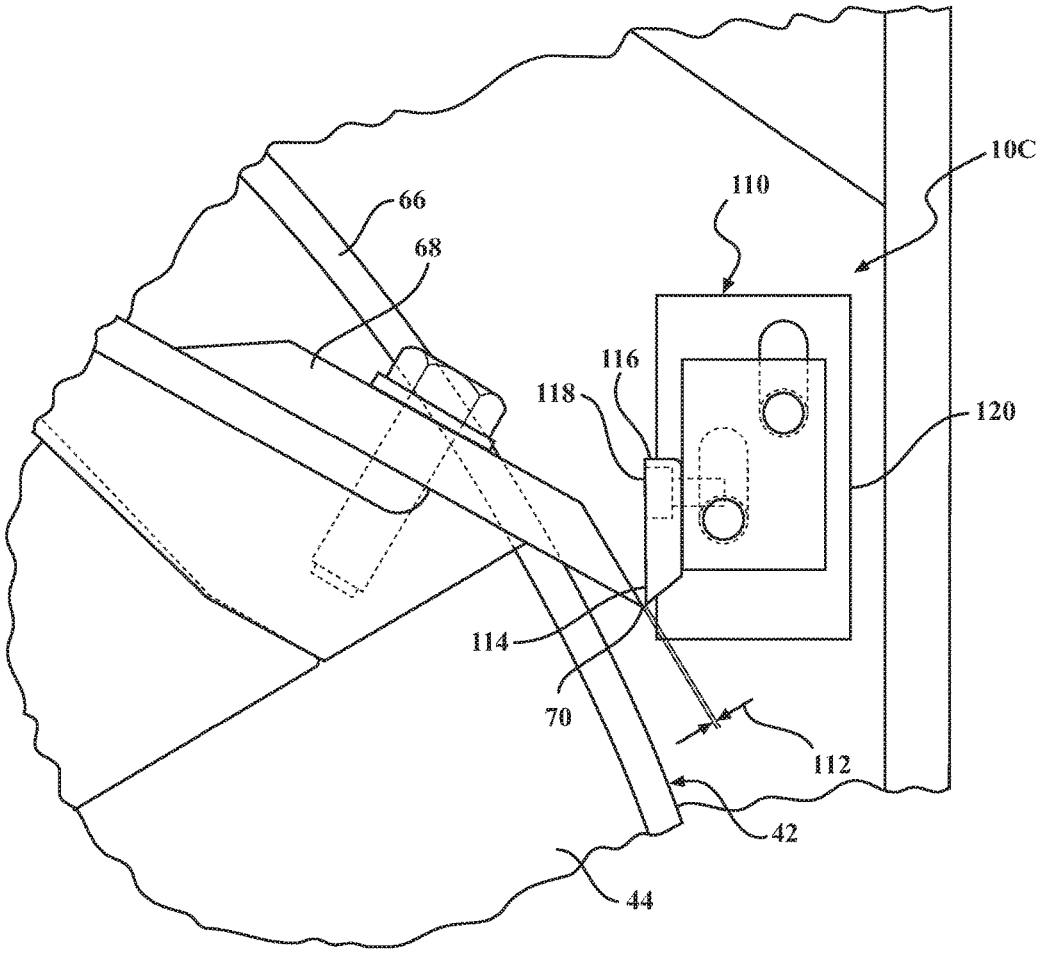
FIG. 16 is an enlarged partial sectional side view of the cutting assembly of the second safety device of FIG. 13.

FIG. 12 depicts yet a further embodiment of first safety device 100 wherein embodiment 10B depicts a first safety device 100B wherein a surface 104 is disposed adjacent a first edge 70 of reducing member 68 and includes a second edge 86B comprising an edge of the support member 80 which is disposed from first edge 70 by a first gap 72B. In this manner the cable 6 may be cleaved against the surface 104 or edge 86B of first safety device 100B by the at least one reducing member 68.

FIGS. 13-16 depict an embodiment 10C of the waste processing system including a second safety device 110 which may be the same in detail, configuration, and operation to first safety device 100 described herein-above. As such, the portion of the specification describing first safety device 100 is wholly incorporated herein to describe second safety device 110 and has been omitted simply for brevity.

Second safety device 110 is also disposed within the cutting chamber 60 and spaced (in this particular case uniformly, though not required) from the rotor 44 (e.g., from first edge 70 of reducing member 68) with respect to a third edge 114 of second safety device 110, thereby defining a fourth gap 112 therebetween. For example only, second safety device 110 may be disposed within the housing 48, radially aft of the first safety device 100, wherein third edge 114 is disposed on a cutter 116, in this example a knife 116, and comprises a sharpened edge 114. As with first safety device 100, the cutter 116 may be disposed along a second safety device fixture or support 120 which is spaced from the rotor 44 (e.g., from first edge 70 of reducing member 68) thereby defining the fourth gap 112 therebetween through which a cable 6 captured by the rotor assembly 42 and not separated by the first safety device 100 is automatically cleaved, cut or otherwise separated between the first cutting edge 70 of the reducing member 68 and the third cutting edge 114 of safety device 110 when the cable 6 is disposed between the fourth gap 112, upon rotation (e.g., operation) of the rotor 44, and as the cable 6 is wrapped further around the rotor 44.

The alternate embodiments illustrated in FIGS. 11-12 and described herein-above, may also be utilized for second safety device 110. Further, first and second safety devices 100 and 110 may comprise the same embodiments, or alternate embodiments between the two safety devices 100 and 110 even though used within the same housing 48.

Again as described herein-above, one embodiment of second safety device 110 comprises a second support member 120 disposed and extending between the first 74 and the second 76 side or wall of housing 48 and may further comprise a second support first end 122 which is disposed on first wall 74 and a second support second end 124 which is disposed on second wall 76.

In one embodiment and for example only, second safety device 110 is disposed radially aft of first safety device 100 by an arc $\alpha$ ranging from 5 degrees to 180 degrees, preferably from 45 degrees to 135 degrees, and more preferably from 70 degrees to 110 degrees. In one embodiment the second device 110 is disposed 80 degrees to 90 degrees from the first device 100.

Further, as described herein-above, the fourth second gap 112 may also be adjustable. The fourth gap 112 may be sized according to the cable 6 that is being used. However, and again for this particular embodiment only and for example only, the fourth gap may range from 0.0 inches to 1.0 inch, preferably from 0.0 inches to 0.5 inch, and more preferably from 0.0625 inches to 0.250 inch, and in one particular embodiment, the fourth gap is 0.125 inches (⅛").

Of course, the above mentioned ranges are for descriptive purposes and not meant to be limiting in any manner, unless so specified in the claims and then, limited only to those respective claims.

As such a safety device for a cutting assembly 40 of a waste processing system, for example a wood chipper 11, which includes a powered cutting system 40 comprising a rotor 44 rotatably mounted within a housing 48, has been invented wherein the improvement relates to a safety device comprising a first safety device 100 disposed within the housing 48 and spaced from the rotor 44 thereby defining a first gap 72 therebetween through which a cable 6 that has been inadvertently and at least partially captured by or wrapped around the rotor 44 during operation thereof is automatically cleaved or separated when the cable 6 becomes disposed between the first safety device 100 and the rotor assembly 42. For example, the rotor 44 may include a reducing member 68 comprising a first edge 70, and the first safety device 100 may include a second edge 86, wherein the cable 6 may be cleaved between the first edge 70 of the reducing member 68 and the second edge 86 of the first safety device 100. Thus the further wrapping or entanglement of the cable 6 is prevented upon the cable 6 being cleaved or separated.

Further, the safety device may also include a second safety device 110 disposed within the housing 48 and spaced from the rotor 44 thereby defining a fourth gap 112 therebetween, wherein the second safety device 110 comprises a third edge 114 wherein the cable 6 may be cleaved between the first edge 70 of the reducing member 68 and the third edge 114 of the second safety device 110.

Figure 17:
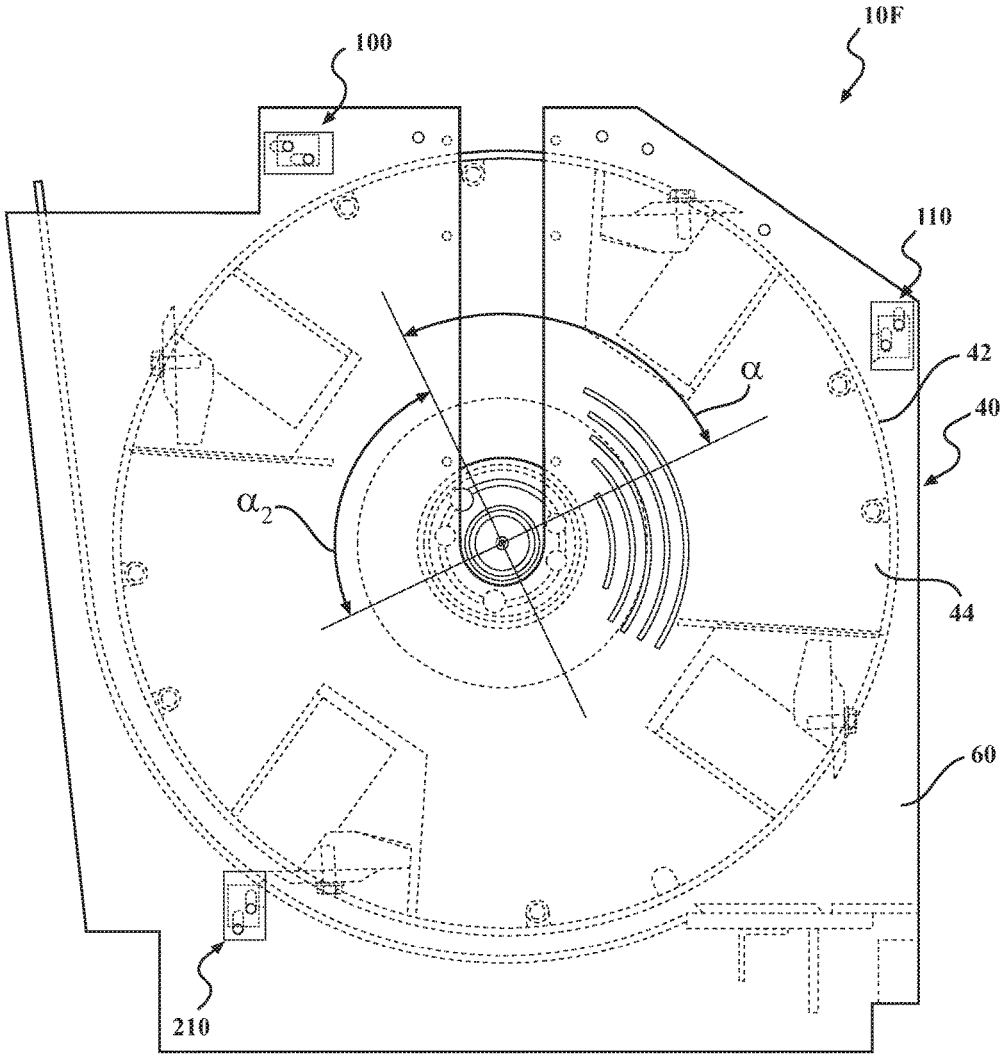
FIG. 17 is a partial sectional side view of a cutting assembly of a waste processing system according to another embodiment of the present invention and illustrating a third safety device.
Figure 18:
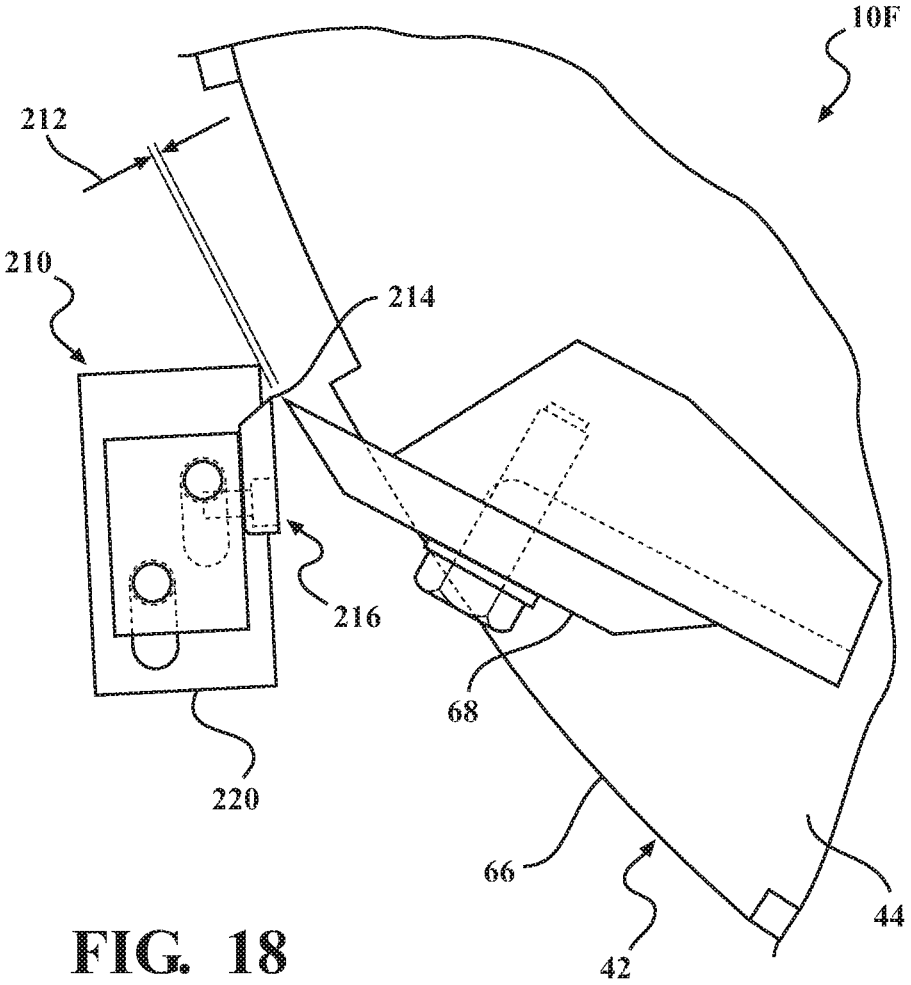
FIG. 18 is an enlarged partial sectional side view of the cutting assembly of the second safety device of FIG. 17.
Figure 19:
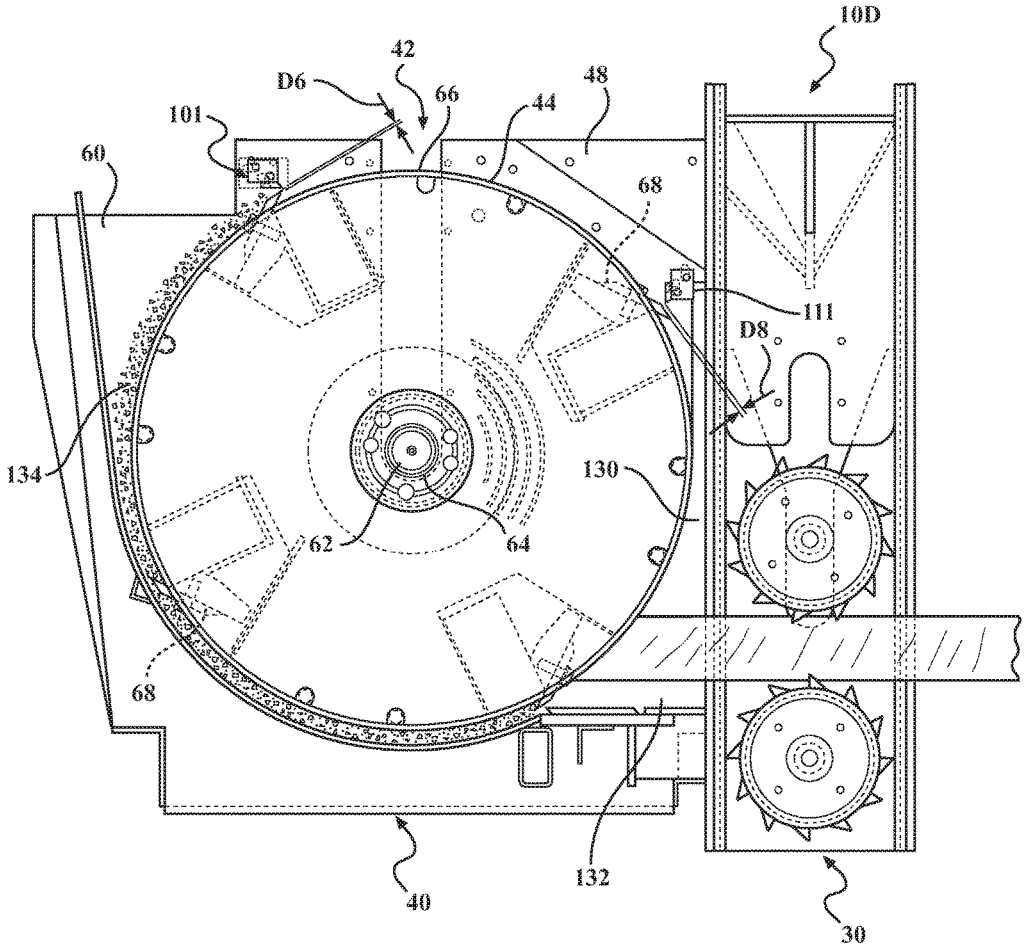
FIG. 19 is a partial sectional side view of the blowback reduction device according to one embodiment of the present invention.
Figure 21:
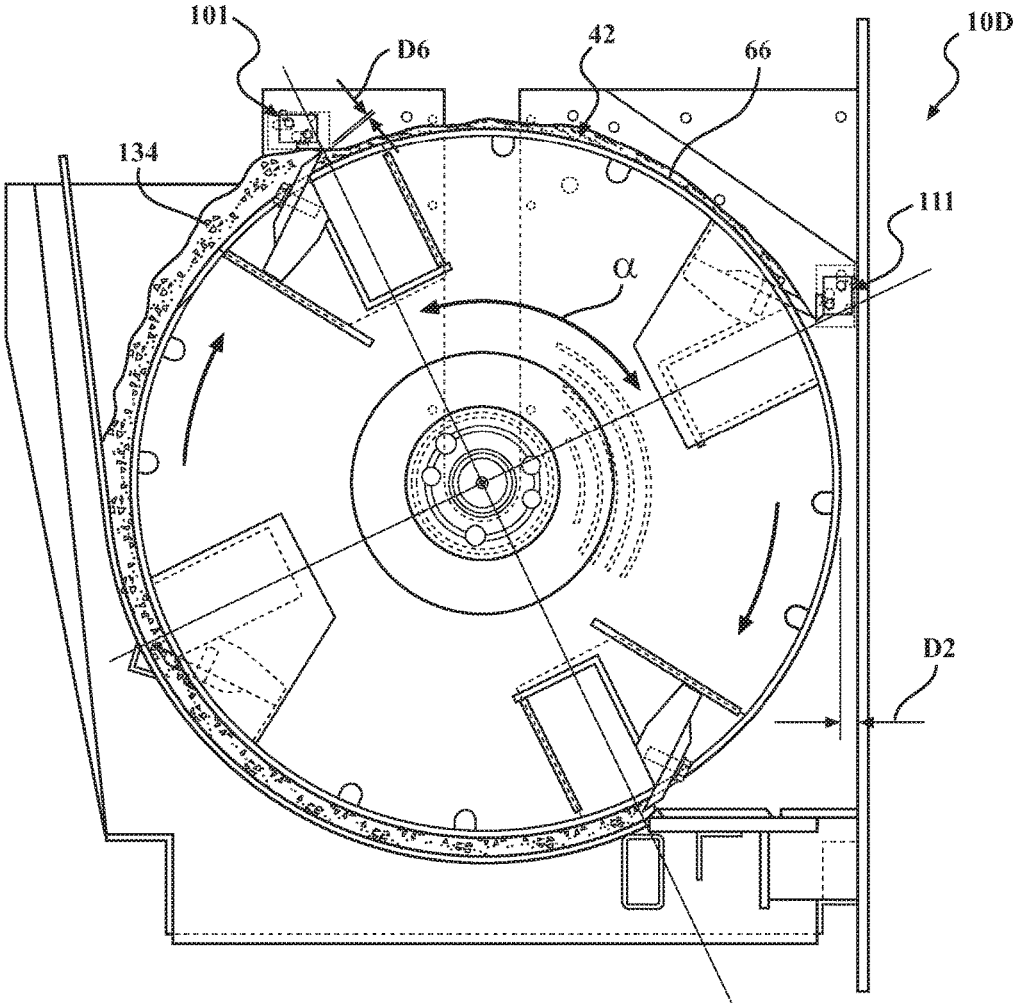
FIG. 21 is a partial sectional side view of the blowback reduction device of FIG. 19, and illustrating material flow.

FIGS. 17-18 depict an embodiment 10F of the waste processing system including a third safety device 210 which may be the same in detail, configuration, and operation to first and second safety devices 100 and 110 described herein-above. As such, the portion of the specification describing first and second safety devices 100 and 110 is wholly incorporated herein to describe third safety device 210 and has been omitted simply for brevity. Additionally, while a single device 100 may be utilized, use of device 100, and further device 210 may increase the probability that any line or cable inadvertently captures will be cut, severed, or otherwise assisted in breaking.

Third safety device 210 is also disposed within the cutting chamber 60 and spaced (in this particular case uniformly, though not required) from the rotor 44 (e.g., from first edge 70 of reducing member 68) with respect to a fourth edge 214 of third safety device 210, thereby defining a fifth gap 212 therebetween. For example only, third safety device 210 may be disposed within the housing 48, radially fore of the first safety device 100, wherein fourth edge 214 is disposed on a cutter 216, in this example a knife 216, and comprises a sharpened edge 214. As with first and second safety devices 100 and 110, respectively, the cutter 216 may be disposed along a third safety device fixture or support 220 which is spaced from the rotor 44 (e.g., from first edge 70 of reducing member 68) thereby defining the fifth gap 212 therebetween through which a cable 6 captured by the rotor assembly 42 is automatically cleaved, cut or otherwise separated between the first cutting edge 70 of the reducing member 68 and the fourth cutting edge 214 of safety device 210 when the cable 6 is disposed between the fifth gap 212, upon rotation (e.g., operation) of the rotor 44, and as the cable 6 is wrapped further around the rotor 44.

The alternate embodiments illustrated in FIGS. 11-12 and described herein-above, may also be utilized for third safety device 210. Further, first, second, and third safety devices 100, 110, and 210, respectively, may comprise the same embodiments, or alternate embodiments even though used within the same housing 48.

Again as described herein-above, one embodiment of third safety device 210 comprises a third support member 220 disposed and extending between the first 74 and the second 76 side or wall of housing 48 and may further comprise a third support first end 222 (not shown) which is disposed on first wall 74 and a third support second end 224 (not shown) which is disposed on second wall 76.

In one embodiment and for example only, third safety device 210 is disposed radially fore of first safety device 100 by an arc α2 ranging from 0 degrees (adjacent 100) to 270 degrees (adjacent 110), preferably from 90 degrees to 180 degrees, and more preferably from 100 degrees to 135 degrees.

Further, as described herein-above, the fifth gap 212 may also be adjustable. The fifth gap 212 may be sized according to the cable 6 that is being used. However, and again for this particular embodiment only and for example only, the fifth gap may range from 0.0 inches to 1.0 inch, preferably from 0.0 inches to 0.5 inch, and more preferably from 0.0625 inches to 0.250 inch, and in one particular embodiment, the fifth gap is 0.125 inches (⅛").

Of course, the above mentioned ranges are for descriptive purposes and not meant to be limiting in any manner, unless so specified in the claims and then, limited only to those respective claims.

Figure 22A:
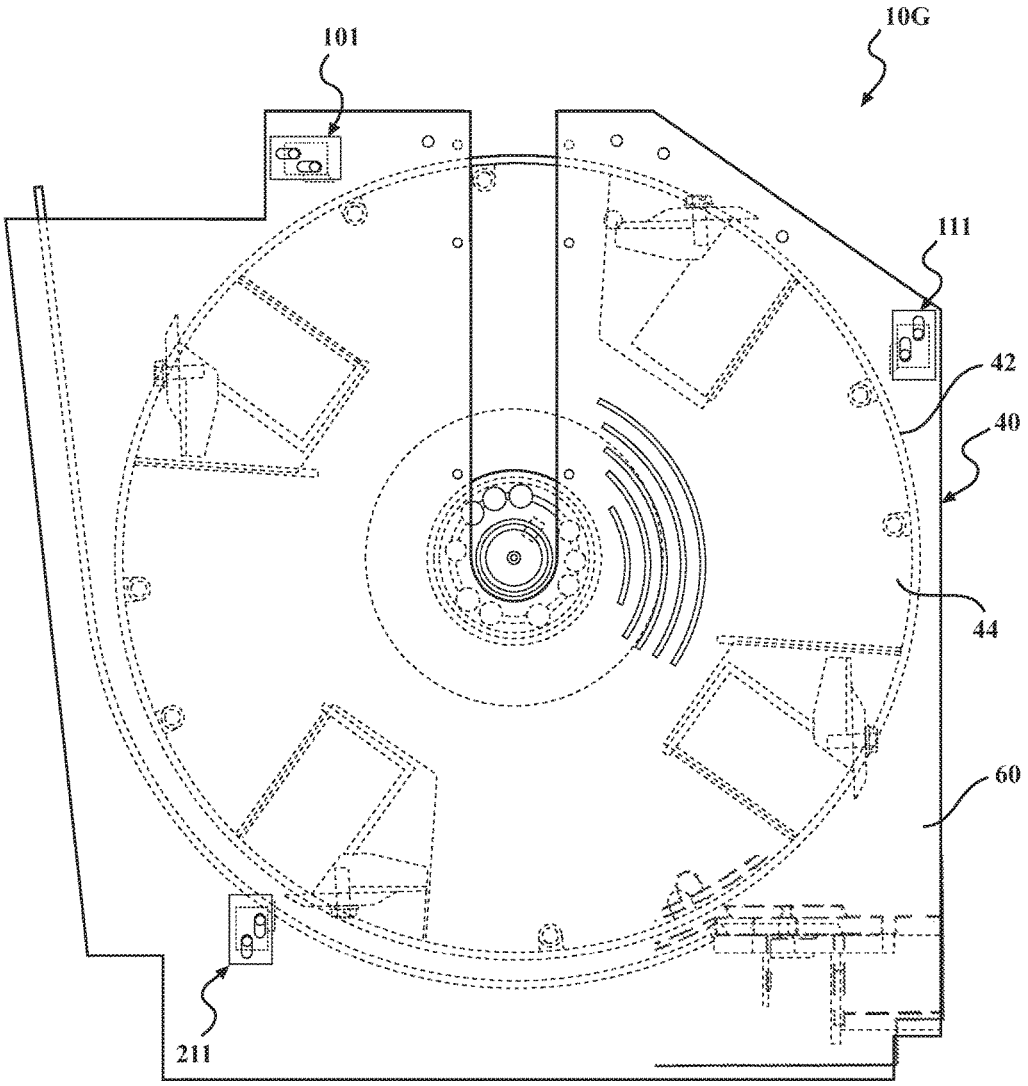
FIG. 22A is a partial sectional side view of another embodiment of the blowback reduction device of the present invention.
Figure 22B:
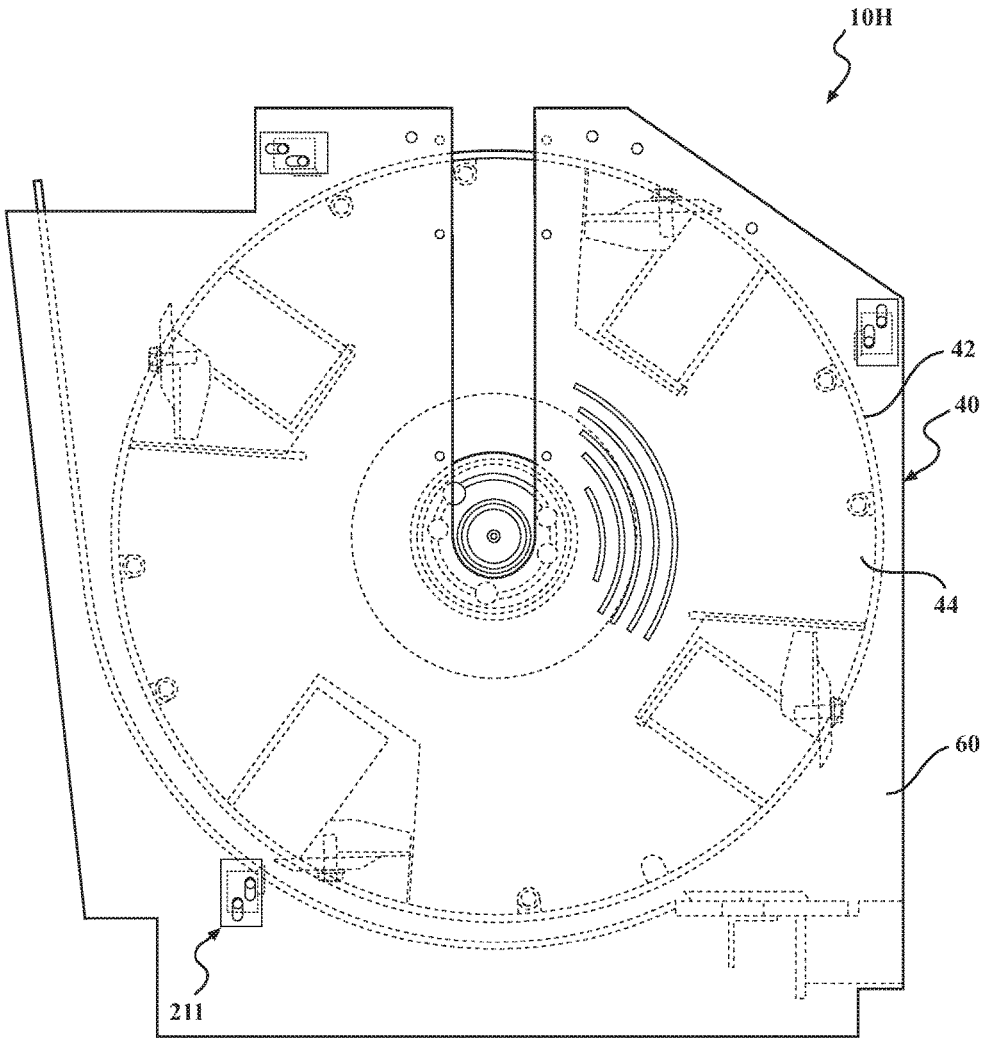
FIG. 22B is a partial sectional side view of yet another embodiment of the blowback reduction device of the present invention.

FIGS. 19-22A illustrate anti-backflow devices 101, 111, and 211, wherein FIGS. 19, 20A, 20B, and 21 depict an embodiment of the waste processing system 10D wherein backflow devices 101 and 111 assist with reducing the backflow or blow-back of the wood particulate in the reducing chamber 60, while FIG. 22A depicts an embodiment 10G comprising backflow devices 101, 111, and 211, while FIG. 22B depicts an embodiment 10H comprising backflow device 211.

Backflow devices 101, 111, and 211 may be the same in detail, configuration, and operation as described herein-above with respect to safety devices 100, 110, and 210, as well as the alternate embodiments. As such, the portion of the specification describing safety devices 100, 110, and 210 is wholly incorporated herein to describe backflow devices 101, 111, and 211, respectively, and has been omitted simply for brevity.

Further, backflow devices 101, 111, and 211 may comprise safety devices 100, 110, and 210; may replace them in whole, in-part, and in any combination thereof; or may be in addition thereto in whole, in-part, and in any combination thereof. Yet further, although not illustrated, backflow device 211 may be utilized in the same manner as devices 101 and 111, the description of which is wholly incorporated herein to describe backflow device 211. As such, the portion of the specification hereinbelow describing first and second devices 101 and 111 is wholly incorporated herein to describe third backflow device 211 and has been omitted simply for brevity.

Backflow occurs due to the tendency of the wood particles 134 to gather, cling to, accumulate, or follow the outside surface 66 of rotor 44 and generally occurs during periods of high demand (e.g., periods of high reduction/chipping by the rotor assembly 42), wherein the reduced particles may proceed to be moved towards the front of the cutting assembly 130, and in certain cases can be drawn back to the entrance 132 which can add to the burden of the chipping or shredding operation of the waste processing system.

If too much backflow is allowed, the chipping or shredding operation can be severely reduced due to the additional material being present that should have otherwise been removed from the system. Of course, if the wood particles are overly restricted in the cutting chamber 60, the chipping or shredding operation can also be negatively affected.

As such, it is desirable to prevent or reduce the backflow in these systems, while not overly restricting them. In the embodiment illustrated, blowback is prevented or reduced utilizing one or more anti-blowback devices (101, 111, 211) and through a first restriction D6 (e.g., the distance between first edge 70 of reducing member 68 and second edge 86 of cutter 82) which restricts the amount of wood particulate that can be passed therethrough.

However, the system is not overly restricted or burdened, in part, because of the intermittent nature of the restriction D6 which acts upon or restricts only when first edge 70 of reducing member 68 and second edge 86 of cutter 82 are aligned. As such, the wood particles are restricted between restriction D6 only during these intermittent times or cycles and at all other times is allowed to flow through a wider second restriction or distance D7 (e.g., the distance between the outside surface 66 of rotor 44 and one of second edge 86 of cutter 82, edge 86A of support 80, or edge 86B of support 80). Therefore, the safety system does not create such a restriction so as to cause a backup or clog which would reduce the output, stall the engine, or otherwise negatively affect performance.

It is to be understood that while safety devices 100, 110, and 210 also assist with reducing the backflow or blow-back and may be used therefor, anti-backflow or anti-blow-back devices (101, 111, 211) may be: the same as; similar to; different from; replace; and in addition to safety devices 100, 110, and 210, and these devices (100, 101, 110, 111, 210, and 211) may be used together, in any combination, or separately, to effectuate this purpose. In the embodiment illustrated, anti-backflow devices 101 and 111 comprise elongated supports.

Figure 23A:
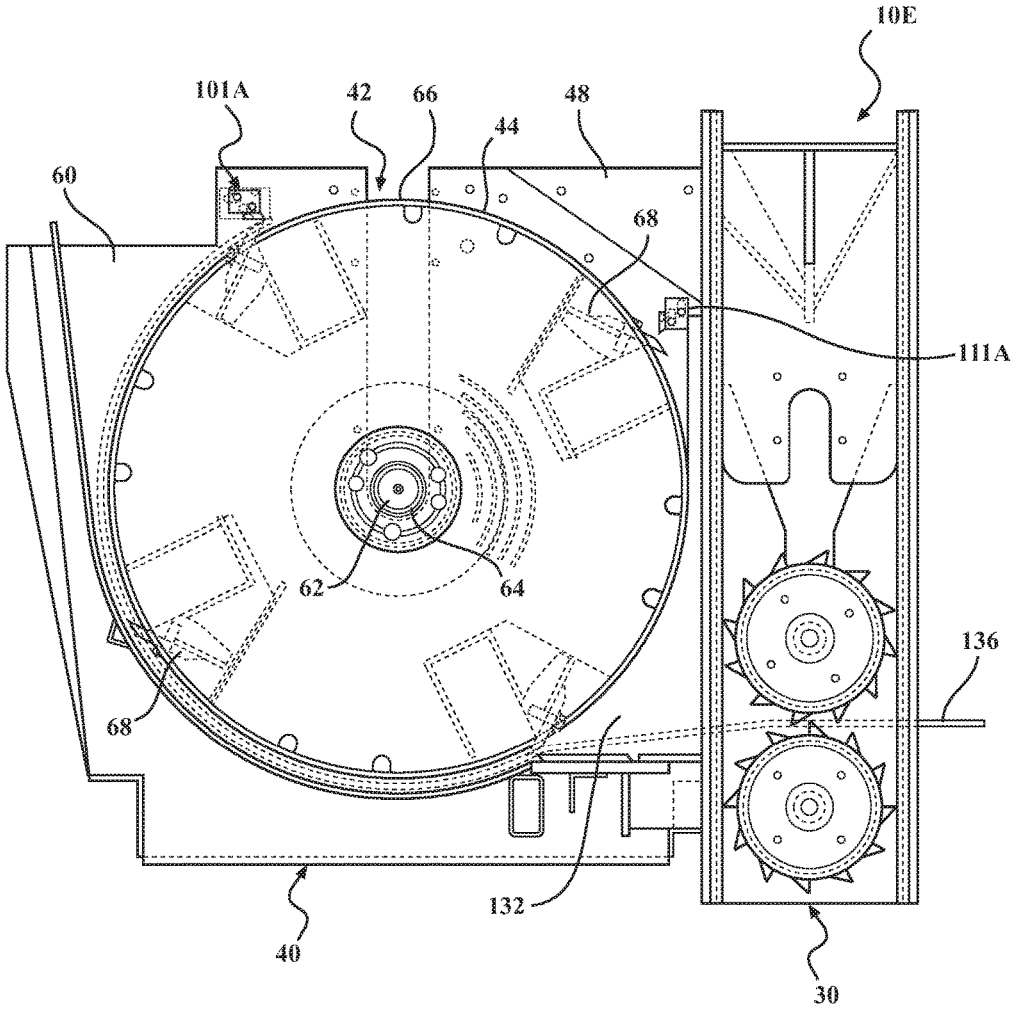
FIG. 23A is an partial sectional side view of a conformable wood processing device according to an embodiment of the present invention.
Figure 23B:
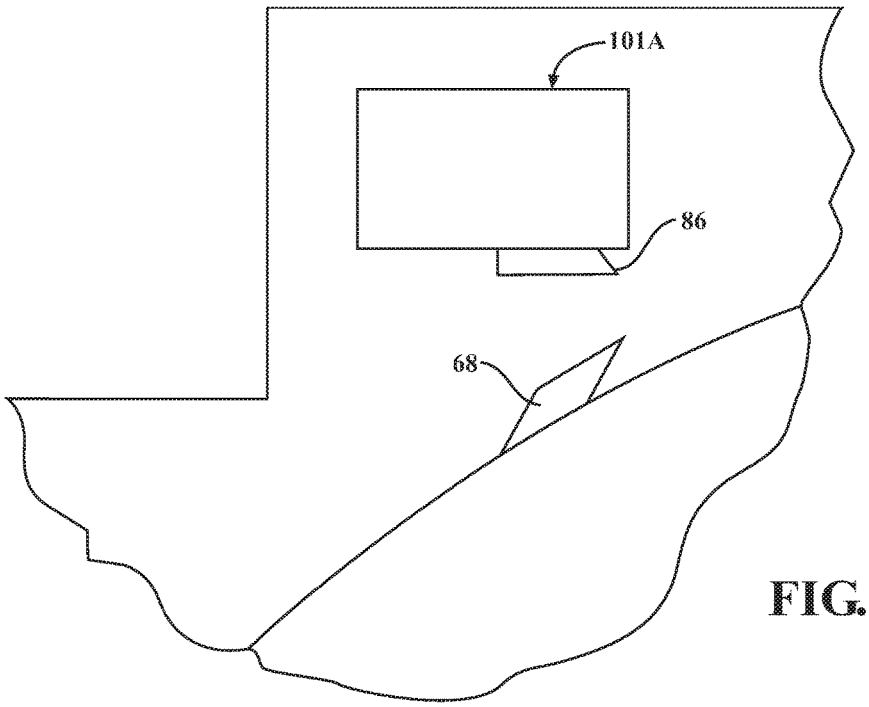
FIG. 23B is an enlarged partial sectional side view of the conformable wood processing device of FIG. 23A.

FIGS. 23A and 23B depict yet another embodiment of the waste processing system 10E wherein conformable wood reduction devices 101A and 111A assist with the processing of conformable wood products. Conformable wood products 136 comprise wood products that arc conformable or bendable and include brush, small branches, and slab wood, as opposed to for example tree logs and tree trunks which are, generally speaking, stiff or otherwise less pliable (e.g., not easily bent).

As used herein, the term conformable wood products is meant to be defined as those woods products that are, while processing, capable of bending around, wrapping around, or otherwise following the contour of the rotor 44. For example, when brush and smaller branches are fed through the cutting system 40, rather than being processed at the front 132 of cutting system 40 (e.g., as logs are), they can flow further into the cutting system 40 and may, generally, follow or wrap around rotor 44 in a similar manner to cable 6 and the backflow of wood particles 134 as described herein-above.

By way of further example, slab wood is an otherwise non usable wood that remains after it has been processed by a saw mill. Slab wood includes for example: the wood remnants cut off of the round portions of the trunk, thereby leaving a square core of usable wood which is processed further by the mill; slab wood also comprises smaller (e.g., in thickness or length) wood and tree parts that are not easily processed by the mill. As such, much of the slab wood from the mills is bendable or conformable. And, while this wood can be processed into wood chips, the conformable nature and flexibility of the product can be problematic for waste processing machines as described herein-above.

As such, it is desirable to provide systems and methods for processing this conformable and slab wood. In the embodiment illustrated, slab wood is able to be processed via one or more elongated supports 101A, 111A which comprise an edge 86, 86A, 86B, 86C, as disclosed herein-above, disposed within the housing 48 and adjacent the rotor 44 in a longitudinal direction, the edge spaced from the rotor by a first distance D7 whereby conformable wood having a thickness T greater than the first distance D7 is prevented from moving past the edge 86C without additional processing via the rotor.

Figure 23C:
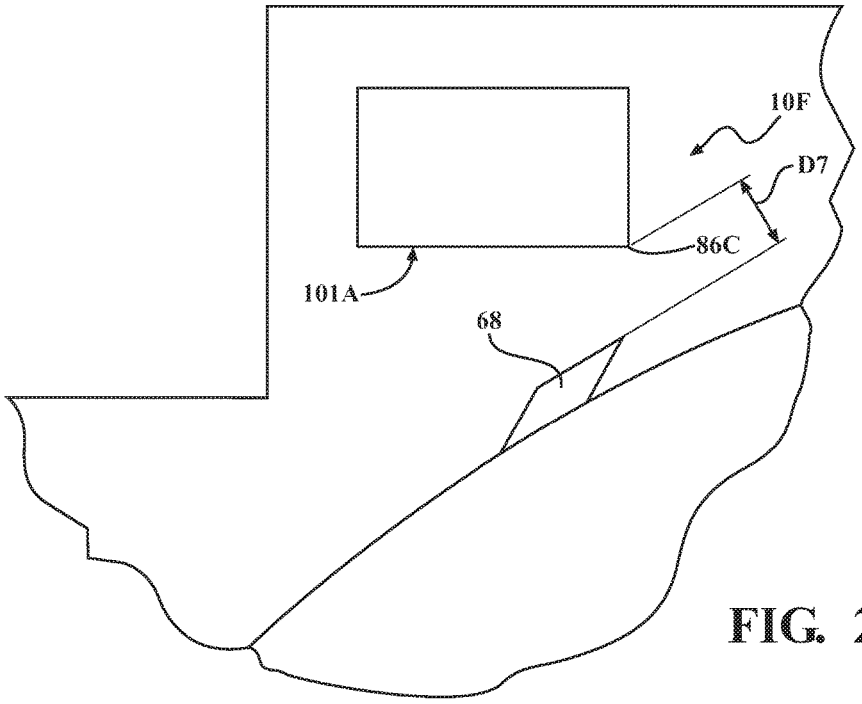
FIG. 23C is an enlarged partial sectional side view of a conformable wood processing device according to another embodiment of the present invention.
Figure 24:
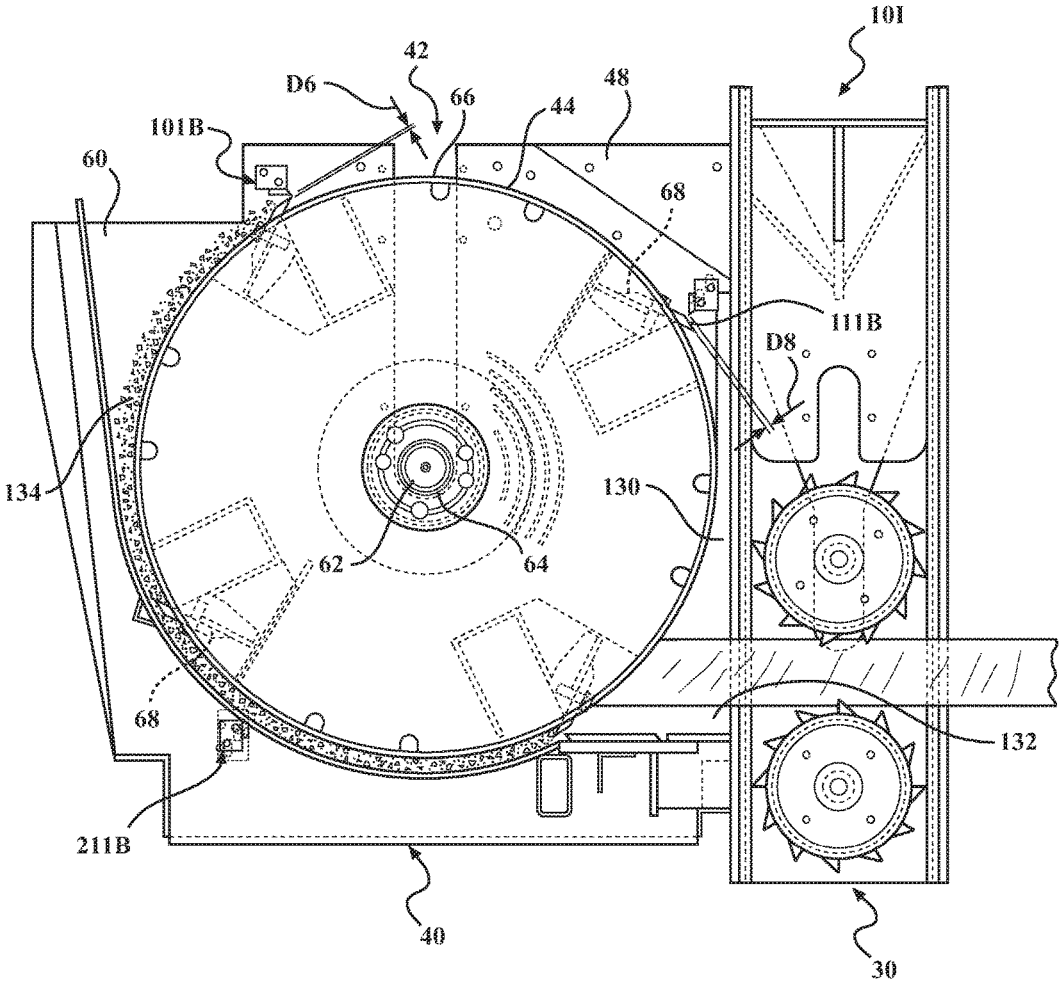
FIG. 24 is an partial sectional side view of a conformable wood processing device according to yet another embodiment of the present invention.

FIG. 23C depicts yet another embodiment of the waste processing system 10F wherein devices 101A, 111A comprise edge 86C, as opposed to edge 86 as depicted in FIG. 23A. FIG. 24 depicts yet another embodiment of the waste processing system 101 wherein devices 10IB, 111B, and 211B are included.

Further, as described herein with respect to the other features and embodiments, it is to be understood that while safety devices 100, 110, and 210 may also assist with reducing backflow as described hereinabove, these safety devices may also assist in the processing of conformable wood products and may be used therefor. As such, conformable processing devices 101A, 101B, 111A, 111B, 211A, and 211B may be the same as, similar to, or different from the safety devices (100, 110, 210), and/or anti-blow-back devices (101, 111, 211) and these conformable processing devices may be used together, in any combination, or separately, to effectuate this purpose.

It is to be understood that the safety devices, blowback devices, and conformable wood processing devices may provide the various clearances, gaps, and openings through the various embodiments illustrated herein and include a simple mechanical restriction and/or obstruction (e.g., a bar extending across the knives of the drum); or via a more complex assembly. Further, the safety features, blowback processing, and conformable wood processing characteristics described herein may be effectuated individually or together, independently or combined.

Further, the safety, blowback, and conformable wood processing devices in providing the various clearances, gaps, and openings and through the various embodiments illustrated herein also effectuate additional processing of the material by the rotor assembly and more particularly, the cutters 68. As such, this additional processing may also provide further assistance with waste reduction and control of chip size, including uniformity. Yet further, while a single device may be utilized, use of multiple devices may increase the probability that any line or cable inadvertently captured will be cut, severed, or otherwise assisted in breaking. Further, the addition of each device will also act to restrict flow thereby allowing the material to be yet further processed.

In use then, a waste processing machine 10 comprising a cutting assembly 40 which may be, for example, a wood chipper 11, is powered up and otherwise made ready for use. Typically, although not required, these systems will include a feed system 30 which may include one or more feed wheels (not shown) to assist with the feeding process. Additionally, and with respect to chipper 11, the system may also include an infeed system 20 which may include an infeed tray 22 and an infeed chute 24. Bulk wood products are then made ready to be reduced by the chipper 11 by introducing or feeding the wood products to the feed system 30 which in turn feeds the cutting system 40. This may be accomplished, for example, through the assistance of a cable 6 which is used to gather, secure, drag, lift, etc., the bulk wood products onto and into the infeed system 20 for capture by the feed system 30. This may be done manually or with the assistance of a winch 2 and winch line 4.

During this gathering and feeding operation, if proper procedures are not followed it is possible for the cables 4 or 6 to be captured by, inter alia, one or more of the feed wheels of the feed system 30 or the rotor assembly 42. Further, once captured by the rotor assembly 42, and due to the high speed of rotation thereof, the cables 4 or 6 can become entangled with or captured by the rotation of the rotor assembly 42, and thereby rapidly be wound therearound.

For example, utilizing a rotor having a diameter of 37 inches and a rotation speed of 1080 revolutions per minute (RPM), the speed at which the cable 4 or 6 is wound is over 118 miles per hour (MPH), or over 174 feet per second (FPS). As such, a 50 foot cable could be retracted in just over ¼ (0.25) of 1.0 second. This time frame is too quick for an operator to react within and as such, when the cable is rapidly retracted from the work area (i.e., the area outside of the chipper) the sudden retraction can cause safety issues. For example, the rapid retraction of the cable can cause the cable, and anything attached thereto, to be uncontrollably flung or whipped around, possibly causing damage or injury to anything or anyone in its path of retraction. Further, if anything is entangled or becomes entangled in the cable either before or during this sudden retraction, it may be rapidly pulled towards the system. As such, it is possible for the system to be damaged by the entangled matter or worse, for an operator to become entangled in the cable and drawn towards and/or into the chipper in such a sudden manner as to have little to no time to react.

As such, the inventive safety device disclosed herein reduces these safety issues by, if the cable becomes entangled, automatically cutting the cable between the rotor assembly and the first, second, or third safety devices as it is being wrapped around the rotor assembly 42, and as described herein-above. As such, physical injuries to operators and other bystanders, as well as damage to these waste processing systems, may be averted.

Also disclosed is a method of cutting a feed cable 6 captured by a rotor assembly 42 of a waste processing machine 10 which includes providing a waste processing machine 10 including a rotor assembly 42 and a first safety device 100, wherein the first safety device 100 is operatively disposed with respect to the rotor assembly 42 so as to provide a first gap 72 therebetween, wherein at least one of the rotor assembly 42 and the first safety device 100 is adapted to cleave a cable 6. The method further comprises the step of feeding the waste processing machine 10 utilizing the assistance of a cable 6, wherein if the cable 6 is captured by the rotor assembly 42 during the operation thereof (e.g., during the feeding operation), the cable 6 upon being disposed adjacent or passing through the first gap 72 will be automatically cleaved or separated via at least one of the rotor assembly 42 and the first safety device 100 thereby preventing (e.g., releasing) the cable from being further wound around the rotor assembly 42.

The method may also include the further step of providing a second safety device 110 operatively disposed with respect to the rotor assembly 42 so as to provide a fourth gap 112 therebetween, wherein if the cable 6 is captured by the rotor assembly 42 during operation of thereof, the cable 6 upon being disposed adjacent and/or passing through at least one of the first 72 and fourth 112 gap will be automatically cleaved via at least one of the rotor assembly 42, the first safety device 100, and the second safety device 110, thereby preventing the cable 6 from being further wound around the rotor assembly 42.

The method may further include the step of providing a third safety device 210 operatively disposed with respect to the rotor assembly 42 so as to provide a fifth gap 212 therebetween, wherein if the cable 6 is captured by the rotor assembly 42 during operation of thereof, the cable 6 upon being disposed adjacent and/or passing through at least one of the first 72, fourth 112, or fifth gap 212 will be automatically cleaved via at least one of the rotor assembly 42, the first safety device 100, second safety device 110, and third safety device 210 thereby preventing the cable 6 from being further wound around the rotor assembly 42.

Another method includes: feeding the waste processing machine 10; allowing a cable 6 to enter the cutting system 40; cutting the cable 6 between the first device 100 and the reducing member 68 when the cable 6 is disposed between the first gap 72; and wherein if the cable 6 is captured by the rotor 44, the cable upon passing through the first gap 72 will be cleaved via at least one of the reducing member 68 and the first device 100 thereby preventing the cable from being further wound around the rotor.

In yet another embodiment, a method of reducing wood particulate backflow in a waste processing machine cutting assembly comprises: providing a cutting assembly 40 for a waste processing machine 10 including a rotor assembly 42 and a blowback reduction device 101 operatively disposed with respect to the rotor assembly so as to provide a first D6 and a second D7 restriction therebetween; feeding the waste processing machine 10 bulk wood product; and intermittently restricting the flow of wood particles within the cutting assembly 40 between the first D6 and second D7 restrictions.

As described herein, the method may further include utilizing a second blowback reduction device 111 to effectuate this purpose, and may further include utilizing a third blowback reduction device 211 to effectuate same.

In yet another embodiment, a method of reducing conformable wood products in a waste processing machine 10 comprises: providing a waste processing machine 10 including a cutting assembly housing 48 having a first 74 and a second side 76, and a rotor assembly 42 operatively disposed therein; providing an elongated bar 101A extending between the first 74 and the second 76 sides and disposed with respect to the rotor assembly 42 so as to provide a first gap D7 therebetween; supplying the waste processing machine 10 with conformable wood product, wherein the conformable wood product includes a thickness (T) that is larger than the first gap D7; feeding the cutting assembly 40 with the conformable wood product; and restricting, preventing, or obstructing the conformable wood by the first gap D7.

As described herein, the method may further include utilizing a second elongated bar 111A to effectuate this purpose, and may further include utilizing a third elongated bar 211A to effectuate same.

In still another embodiment, a method of reducing slab wood in a waste processing machine including a cutting assembly housing 48 having a first 74 and a second side 76, a rotor assembly 42 operatively disposed therein, and an obstruction 101A extending between the first 74 and the second sides 76 and spaced from the rotor assembly 42 by a first gap D7, the method comprising: feeding the waste processing machine 10 slab wood product; preventing the slab wood from proceeding past the obstruction 101A; and processing the slab wood in the cutting assembly 40 until the processed slab wood is able to pass through the first gap D7.

As described herein, the method may further include utilizing a second obstruction 111A to effectuate this purpose, and may further include utilizing a third obstruction 211A to effectuate same.

While a linear sequence of events has been described, it should be appreciated that various modifications can be made therein and, as such, the system does not necessarily require a linear sequence of events. It is also to be understood that various modifications may be made to the system, it sequences, methods, orientations, and the like without departing from the inventive concept and that the description contained herein is merely a preferred embodiment and hence, not meant to be limiting unless stated otherwise.

It should be understood that waste processing system 10 may comprise any suitable waste reducing machinery such as the trailerable wood chipper as seen in FIG. 4, or any other, typically, movable machinery used to chip, grind, cut, or otherwise reduce bulk products. Further, while the preferred embodiment incorporates a pair of opposed, horizontally aligned feed wheels, it is to be understood that any feed system may be utilized, or none at all. Still further, it is to be understood that numerous configurations of these known devices may be used and the description herein is not meant to be limiting with respect to these systems, unless otherwise noted, and equivalent components may be used.

To wit, safety devices, systems and methods have been disclosed wherein waste processing systems may be configured to increase the safety associated with the operation thereof, as well as to increase the control thereof, as well as to increase the processing capability thereof. Further, novel systems and methods are disclosed which may be supplied with new (factory built) waste processing cutting systems, or retrofitted to existing cutting and waste processing systems.

Advantageously, the waste processing system of the present invention includes, among other advantages, the ability to increase safety, while providing systems and methods that are simple, useful, cost effective, and increase the productivity of these machines.

The solutions offered by the invention disclosed herein have thus been attained in an economical and practical manner. To wit, novel systems and methods for increasing the safety and production of waste processing systems which are cost effective, easily configurable, and provide for increased operator and system safety have been invented. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to appreciated that various changes, rearrangements, and modifications may be made therein, without departing from the scope of the invention as defined by the claims.

The invention claimed is:

1. A wood chipper comprising:

a housing defining an entrance for receiving wood material, a cutting chamber having a first side and a second side and adapted for processing wood material, received from the entrance, and an exit for expelling reduced material from the cutting chamber;

a support member having a horizontally disposed axle operatively disposed between the first and second sides of the housing;

an infeed assembly;

a rotatable cutting assembly spaced from the infeed assembly with the cutting assembly operatively disposed within the housing, and the cutting assembly comprising a rotor assembly rotatably coupled to the axle of the support member;

the rotor assembly comprising a rotor, and at least one reducing member mounted to the rotor and extending from an outside surface of the rotor with the reducing member comprising a first edge for cutting the wood material downstream of the entrance and upstream of the exit;

at least one feed wheel disposed between the infeed assembly and the cutting assembly to feed the wood material to the cutting assembly;

a discharge system adjacent the cutting assembly and communicating with the exit to remove reduced material from the cutting assembly;

at least one safety device downstream of the exit and upstream of the entrance, the at least one safety device disposed between the first and second sides within the cutting chamber, and uniformly spaced from the outside surface of the rotor to define at least a first gap therebetween, the at least one safety device further comprising at least one cutter comprising at least one edge for scoring a cable that is at least partially captured by the rotor assembly.

2. The wood chipper as set forth in claim 1, wherein:

the first safety device comprises a second edge wherein the cable is cleaved between the first edge of the reducing member and the second edge of the first safety device.

3. The wood chipper as set forth in claim 1, further comprising:

a second safety device disposed within the reducing chamber, downstream of the exit, and upstream of the entrance, and the second safety device being spaced from the rotor and defining one of the at least first gap therebetween.

4. The wood chipper as set forth in claim 1, further comprising:

a second safety device disposed and extending between the first and the second side.

5. The wood chipper as set forth in claim 1, wherein:

the first safety device and the at least one reducing member are adapted to cleave the cable.

6. The wood chipper as set forth in claim 1, wherein:

the first safety device comprises a second edge which is fixedly disposed a uniform first distance from the rotor.

7. The wood chipper as set forth in claim 1, wherein:

the first safety device comprises a second edge wherein the cable is cleaved between the second edge and at least one of the reducing member and the rotor.

8. The wood chipper as set forth in claim 1, wherein:

the first safety device includes a support member operatively connected to the housing and a cutter mounted to the support member, the cutter comprising a second edge and adapted to be adjustably disposed on the first safety device.

9. The wood chipper as set forth in claim 8, wherein:

the second edge of the cutter is disposed less than 0.5 inches from a first edge of the reducing member.

10. The wood chipper as set forth in claim 8, wherein:

the cutter is a knife.

11. The wood chipper as set forth in claim 1, wherein:

the gap is less than 0.5 inches.

12. The wood chipper as set forth in claim 2, wherein:

the second edge of the first safety device is spaced from the first edge of the reducing member and defining the first gap therebetween, wherein the first gap is less than a distance the first edge of the reducing member extends from the rotor.

13. The wood chipper as set forth in claim 1, wherein:

wherein the first gap is from a range of 0.1% to 0.4% of a diameter of the rotor.

14. The wood chipper as set forth in claim 1, wherein:

the first gap comprises a first distance which is less than any other second distance between an outside surface of the rotor assembly and any other surface disposed within the reducing chamber and parallel to the outside surface of the rotor assembly.

15. The wood chipper as set forth in claim 1, wherein:

the gap comprises a first distance which is less than any other second distance between an outside surface of the rotor assembly and any other device disposed between the first and second sides of the housing.

16. The wood chipper as set forth in claim 1, wherein:

the gap comprises a first clearance which is less than any other second clearance within the housing.

17. The wood chipper as set forth in claim 1, wherein:

a distance between a first edge of the reducing member and a second edge of the first safety device defines a cutting zone, wherein any object wrapped about the rotor and passing through the cutting zone is cut off.

18. The wood chipper as set forth in claim 1, wherein:

the second safety device comprises a third edge wherein the cable may be cleaved between the first edge of the reducing member and the third edge of the second safety device.

19. The wood chipper as set forth in claim 1, comprising:

a second safety device disposed within the housing radially aft of the first safety device including a fixed third cutting edge spaced from the rotor thereby defining one of the at least first gap therebetween through which a cable captured by the rotor assembly and not separated by the first safety device is automatically cleaved between the first cutting edge of the reducing member and the third cutting edge of the second safety device when the cable is disposed between one of the at least first gap, upon rotation of the rotor, as the cable is wrapped further around the rotor.

20. The wood chipper as set forth in claim 1, wherein:

the second safety device is disposed radially 90 degrees from the first safety device.

21. The wood chipper as set forth in claim 1, wherein:

the housing comprises a first, and a second side, the support member operatively connected to and disposed between the first and second sides.

22. The wood chipper as set forth in claim 1, wherein:

the infeed assembly comprises an infeed tray.

23. The wood chipper as set forth in claim 1, comprising:

a second safety device disposed downstream of the exit and upstream of the entrance, the second safety device further being disposed and extending between the first and second sides within the cutting chamber, and uniformly spaced from the outside surface of the rotor and defining one of the at least first gap therebetween;

the second safety device further comprising a second cutter comprising a third edge; and wherein a cable at least partially captured by the rotor assembly may be cleaved between the at least one of the first edge of the reducing member and the second edge of the first safety device, and the at least one of the first edge of the reducing member and the third edge of the second cutter, when the cable is disposed between at least one of the first or the second gap.

24. The wood chipper as set forth in claim 1, wherein:

the first and second cutters are adjustable so as to adjust a first gap and a second gap.

25. The wood chipper as set forth in claim 1, wherein:

the second and third edge of the first and second cutter are disposed less than 0.5 inches from the first edge of the reducing member.

26. The wood chipper as set forth in claim 1, comprising:

the safety device having an edge adapted to be spaced from an outside surface of the rotor thereby defining an intermittent gap between the reducing member and the edge through which a cable inadvertently disposed therebetween and having a diameter larger than the intermittent gap is at least partially cleaved; and a first safety device disposed and extending between the first and second sides of the reducing chamber and spaced from an outside surface of the rotor thereby defining a first intermittent gap therebetween through which a cable at least partially wrapped around the rotor assembly is at least partially cleaved between the first safety device and the rotor assembly when the cable is disposed between the first intermittent gap.

27. The wood chipper as set forth in claim 1, wherein the at least one safety device is further defined as an elongated support adapted to be disposed within the housing, adjacent to the rotor, and spaced from the rotor thereby defining a first restriction therebetween through which wood particles are restricted from travelling further along the rotor via the first restriction.

28. The wood chipper as set forth in claim 27, comprising:

a knife affixed to the elongated support and disposed between the support and the rotor.

29. The wood chipper as set forth in claim 1, comprising: wherein the at least one safety device is further defined as an elongated support comprising an edge, the support disposed within the housing and adjacent the rotor in a longitudinal direction, the edge spaced from the rotor by a first distance;

whereby conformable wood having a thickness greater than the first distance is prevented from moving past the edge without additional processing via the rotor.

30. The wood chipper as set forth in claim 1, further including:

a third safety device disposed within the housing and spaced from the rotor and defining one of the at least first gap therebetween, wherein the third safety device comprises a fourth edge wherein the cable may be cleaved between the first edge of the reducing member and the third edge of the second safety device.

31. The wood chipper as set forth in claim 1, further including:

a third safety device disposed within the housing radially fore of the first safety device and including a fixed fourth cutting edge spaced from the rotor thereby defining one of the at least first gap;

therebetween is automatically cleaved between the first cutting edge of the reducing member and the fourth cutting edge of the third safety device when the cable is disposed within one of the at least first gap, upon rotation of the rotor, as the cable is wrapped further around the rotor.

32. The wood chipper as set forth in claim 1, further including:

a third safety device disposed and extending between the first and the second side.

33. The wood chipper as set forth in claim 1, further comprising:

a third safety device disposed within the reducing chamber and spaced from the rotor and defining one of the at least first gap therebetween.

34. The wood chipper as set forth in claim 1, further comprising:

a third safety device disposed and extending between the first and second sides within the cutting chamber, and uniformly spaced from the outside surface of the rotor and defining one of the at least first gap therebetween, the third safety device further comprising a third cutter comprising a third edge.

35. The wood chipper as set forth in claim 1, wherein the at least one safety device comprises a single safety device.

* * * * *